US006793005B2

(12) United States Patent
Lee et al.

(10) Patent No.: US 6,793,005 B2
(45) Date of Patent: Sep. 21, 2004

(54) METHOD AND APPARATUS FOR CONTINUOUSLY CASTING URANIUM ROD

(75) Inventors: Yoon-Sang Lee, Daejeon (KR); Chang-Kyu Kim, Daejeon (KR); Ki-Hwan Kim, Daejeon (KR); Se-Jung Jang, Daejeon (KR); Young-Joon Shin, Daejeon (KR); Seong-Won Park, Daejeon (KR)

(73) Assignees: Korea Atomic Energy Research Institute (KR); Korea Hydro & Nuclear Power Co., Ltd. (KR)

( * ) Notice: Subject to any disclaimer, the term of this patent is extended or adjusted under 35 U.S.C. 154(b) by 0 days.

(21) Appl. No.: 10/298,357

(22) Filed: Nov. 18, 2002

(65) Prior Publication Data

US 2003/0234096 A1 Dec. 25, 2003

(30) Foreign Application Priority Data

Jun. 24, 2002 (KR) ..... 2002-35445
Jul. 30, 2002 (KR) ..... 2002-45091
Jul. 30, 2002 (KR) ..... 2002-45092

(51) Int. Cl.[7] ..... B22D 11/00; B22D 11/128

(52) U.S. Cl. ..... 164/415; 164/256; 164/263; 164/474

(58) Field of Search ..... 164/474, 475, 164/477, 253, 256, 258, 415, 263, 418

(56) References Cited

U.S. PATENT DOCUMENTS 3,800,848 A * 4/1974 Chaulet et al. ..... 164/453
4,341,261 A * 7/1982 Thomson et al. ..... 164/475

FOREIGN PATENT DOCUMENTS

JP 11-179499 * 7/1999

* cited by examiner

*Primary Examiner*—Kuang Y. Lin
(74) *Attorney, Agent, or Firm*—Cantor Colburn LLP

(57) ABSTRACT

Disclosed are a method and an apparatus for continuously casting a uranium rod so that impurities generated in melting the metallic substance reduced from nuclear spent fuel are easily removed, the molten metal is easily degassed, the oxidation of uranium is prevented, and the molten metal does not remain in a crucible, thereby completely removing the noxious gas, improving the safety of work, allowing the workers to be close to the apparatus, reducing the consumption rate of the inert gas, completely preventing the oxidation of uranium, and being remotely controlled.

17 Claims, 16 Drawing Sheets

METHOD AND APPARATUS FOR CONTINUOUSLY CASTING URANIUM ROD

BACKGROUND OF THE INVENTION

1. Field of the Invention

The present invention relates to a method and an apparatus for continuously casting a uranium rod by melting a metallic substance reduced from nuclear spent fuels, and more particularly to a method and an apparatus for continuously casting a uranium rod so that impurities generated in melting the metallic substance reduced from nuclear spent fuels are easily removed, the molten metal is easily degassed, the oxidation of uranium is prevented, and residue of the molten metal does not remain in a crucible.

2. Description of the Related Art

Generally, nuclear spent fuels generated during nuclear power generation still comprise a great quantity of uranium. In order to effectively store and manage the nuclear spent fuels, the nuclear spent fuels are reduced to a metallic substance without any separation and purification, and then cast into a uranium rod for storage.

By casting the metallic substance reduced from nuclear spent fuel into a uranium rod, the nuclear spent fuel can be easily stored and treated, and recycled as a nuclear fuel, thereby creating an economic benefit.

In order to achieve such economic benefit, a method for continuously casting the metallic substance reduced from nuclear spent fuels into the uranium rods is used. For conventional continuous casting, a method and an apparatus for melting a uranium ingot and degassing the molten uranium in an air-sealed chamber with a designated degree of vacuum and then extracting a uranium rod from the air-sealed chamber by a start rod and a driving roller are proposed.

However, in the conventional continuous casting method and apparatus, since the cast uranium rod is pulled down from the bottom of the air-sealed chamber, it is very difficult to maintain the designated degree of vacuum of the air-sealed chamber. As a result, the uranium rod around the bottom surface of the air-sealed chamber, in which the vacuum is reversed, is easily oxidized.

In order to solve the aforementioned problem, another continuous casting method and its apparatus are proposed. Herein, the air-sealed chamber is filled with an inert gas, and then the continuous casting of a uranium rod is carried out.

In the inert gas atmosphere, the molten metal cannot be sufficiently degassed, thereby manufacturing a poor quality uranium rod.

Further, in order to prevent the oxidation of uranium, a great quantity of inert gas must be continuously supplied to the air-sealed chamber, thereby wasting the inert gas.

In order to solve the aforementioned problems according to the use of the inert gas, another continuous casting method and its apparatus are proposed. Herein, the nuclear spent fuel is melted in the air-sealed chamber under the vacuum condition, and the uranium rod is pushed out from the top of the air-sealed chamber by the high-pressure inert gas.

In this continuously casting method and apparatus, since the uranium rod is pushed upward by the high pressure, the degassing and the prevention of oxidation are possible. However, the molten metal is not completely exhausted. That is, the residue of the molten metal remains in the air-sealed chamber.

The residue of the molten metal in the air-sealed chamber is easily hardened. As a result, in order to reuse the air-sealed chamber, a step for removing the hardened residue of the molten metal is necessary. Further, since workers cannot be easily close to the air-sealed chamber containing the radioactive residue of the molten metal, in order to reuse the continuous casting apparatus, additional steps and much time are required, thereby drastically shorting a recycle rate of the continuous casting apparatus.

Moreover, the workers removing the radioactive substance, i.e., the residue of the molten metal, are exposed to the environmental contaminants such as the radioactivity, thereby being unsafe to perform.

This continuous casting apparatus does not comprise a shielding chamber. Therefore, when the cast uranium rod is pushed out from the top surface of the air-sealed chamber, noxious gas exhausted along with the uranium rod cannot be properly sucked and the radioactivity cannot be shielded.

Further, the above-described continuous casting apparatus comprises a mold serving as a straw for sucking the molten metal within the crucible. The mold in the crucible must have a sufficient length. The outer surface of the uranium rod molded via the long mold is easily damaged, thereby increasing a defective ratio of uranium rods.

In order to suck and pull up the uranium rod from the molten metal within the crucible, the lower part of the mold must be put into the molten metal. Therefore, the repeated insertion of the mold into the molten metal accumulates the damage of the mold, and the mold is contaminated with radioactivity.

In order to minimize the residue of the molten metal in the crucible, the crucible must be moved upward within the air-sealed chamber under high temperature and high pressure conditions, thereby causing breakdowns or failures of the apparatus and break-out of the cast uranium rod due to the non-uniform suction.

SUMMARY OF THE INVENTION

Therefore, the present invention provides a method for continuously casting a uranium rod, in which the impurities generated in melting a metallic substance reduced from a nuclear spent fuel (that is a highly radioactive substance) is easily removed, the molten metal is easily degassed, the oxidation of uranium is prevented, and residue of the molten metal does not remain in the crucible.

The present invention provides a method for continuously casting a uranium rod, in which the inert gas filled in the air-sealed chamber has a constant pressure similar to atmospheric pressure.

The present invention provides a method for continuously casting a uranium rod, in which the cast uranium rod is continuously pulled down without being breakout.

The present invention provides a method for continuously casting a uranium rod, in which the cast uranium rod molded via a mold is cooled at a constant temperature.

The present invention provides a method for continuously casting a uranium rod, in which the first cooled uranium rod is secondarily and completely cooled by the inert gas prior to being exhausted into the shielding chamber.

The present invention provides a method for continuously casting a uranium rod, in which a noxious gas exhausted along with the uranium rod is completely sucked.

The present invention provides a method for continuously casting a uranium rod, in which the exhausted uranium rod is cut without interfering with the continuous casting process.

The present invention provides a method for continuously casting a uranium rod, in which the cut uranium rod is transferred and stored.

The present invention provides an apparatus for continuously casting a uranium rod, in which the impurities generated in melting a metallic substance reduced from a nuclear spent fuel (that is a highly radioactive substance) are easily removed, the molten metal is easily degassed, the oxidation of uranium is prevented, and residue of the molten metal does not remain in the crucible.

The present invention provides an apparatus for continuously casting a uranium rod, in which a region including a driving roller under the air-sealed chamber is shielded from the radioactivity generated from the cast uranium rod.

The present invention provides an apparatus for continuously casting a uranium rod, in which the uranium rod within the mold is not breakout due to the sudden temperature difference but is continuously pulled down.

The present invention provides an apparatus for continuously casting a uranium rod, in which the thermal losses in the crucible and the mold are prevented by an adiabatic material.

The present invention provides an apparatus for continuously casting a uranium rod, in which the uranium rod, molded via the mold and pulled down from the mold, is firstly cooled.

The present invention provides an apparatus for continuously casting a uranium rod, in which a start rod inserted into the crucible is stably supported and fixed.

The present invention provides an apparatus for continuously casting a uranium rod, in which the nuclear spent fuel is introduced from the upper part of the air-sealed chamber into the crucible.

The present invention provides an apparatus for continuously casting a uranium rod, in which the start rod is not easily melted by the molten uranium, and is easily assembled and dissembled.

The present invention provides an apparatus for continuously casting a uranium rod, in which the uranium rod is easily cut without interfering with the continuous casting process.

The present invention provides an apparatus for continuously casting a uranium rod, in which the inert gas filled in the air-sealed chamber is automatically exhausted when a pressure of the chamber is greater than a designated pressure.

The present invention provides an apparatus for continuously casting a uranium rod, in which the air-sealed chamber is easily opened and closed.

The present invention provides an apparatus for continuously casting a uranium rod, in which the first cooled uranium rod is secondarily and completely cooled by the inert gas prior to being exhausted into the shielding chamber.

The present invention provides an apparatus for continuously casting a uranium rod, in which the noxious gas exhausted along with the uranium rod, is locally and completely sucked.

The present invention provides an apparatus for continuously casting a uranium rod, in which the crucible, the mold, and the cooling section are supported within the air-sealed chamber.

The present invention provides an apparatus for continuously casting a uranium rod, in which the uranium rod is cooled at a constant temperature by the cooling section.

The present invention provides an apparatus for continuously casting a uranium rod, in which the cut uranium rod is cut and then transferred.

The present invention provides an apparatus for continuously casting a uranium rod, in which the uranium rod pulled down via the mold and the cooling section within the air-sealed chamber is visually inspected by a worker with naked eyes.

The present invention provides an apparatus for continuously casting a uranium rod, in which the cut and transferred uranium rod is stored in the lower shielding chamber.

In accordance with one aspect of the present invention, the above and other objects can be accomplished by the provision of a continuous casting method for melting a metallic substance reduced from a nuclear spent fuel and casting the molten metal into a uranium rod, comprising: a vacuum melting step for forming a vacuum condition in an air-sealed chamber provided with a crucible and melting the metallic substance reduced from nuclear spent fuel introduced into the crucible under the vacuum condition by heating the crucible; an inert gas filling step for reversing the vacuum condition of the air-sealed chamber and filling the air-sealed chamber with an inert gas; a uranium rod pulling down step for pulling down the uranium rod from the crucible filled with the molten metal in the inert gas atmosphere by downwardly moving a start rod inserted into a mold by a driving roller; a uranium rod cooling step for cooling the pulled out uranium rod by a cooling jacket installed around the uranium rod; and a uranium rod exhausting step for exhausting the cooled uranium rod into a hermetically sealed shielding chamber.

The continuous casting method, between the inert gas filling step and the uranium rod pulling down step, may further comprise a pressure maintaining step for maintaining a constant pressure of the air-sealed chamber by exhausting the inert gas injected into the air-sealed chamber in case the inert gas is in a high pressure state.

Further, in the uranium rod pulling down step, the uranium rod may be pulled down by repeating the pulling out of the start rod and the uranium rod within a designated period of time and then the stopping of the pulling-out of the start rod and the uranium rod within another designated period of time.

Further, the continuous casting method, between the uranium rod pulling down step and the uranium rod cooling step, may further comprise a cooling water volume controlling step for sensing a temperature of the mold and then controlling a cooling water volume according to the sensed temperature of the mold.

Further, the continuous casting method, between the uranium rod-cooling step and the uranium rod-exhausting step, may further comprise a gas-cooling step for secondarily cooling the uranium rod firstly cooled by the cooling water by the inert gas.

Further, the continuous casting method, after the uranium rod exhausting step, may further comprise a noxious gas sucking step for completely sucking a noxious gas exhausted along with the exhaustion of the uranium rod by a local suction device installed around the uranium rod pulled down into the shielding chamber.

Further, the continuous casting method, after the uranium rod exhausting step, may further comprise a uranium rod cutting step for cutting the uranium rod exhausted from the shielding chamber to the outside.

Further, the continuous casting method, after the uranium rod-cutting step, may further comprise a transferring and storing step for transferring the cut uranium rod and storing the transferred into a storage shed.

In accordance with another aspect of the present invention, there is provided a continuous casting apparatus, in which a crucible surrounded with a high frequency induction coil is disposed within an air-sealed chamber, a mold and a cooling section are successively disposed under the crucible, a driving roller is disposed below the air-sealed chamber, thereby casting and pulling down a uranium rod via the mold using a start rod, comprising: a vacuum generating section for forming a vacuum in the air-sealed chamber, including an air exhaust pipe disposed on a side of the air-sealed chamber so as to be connected to the air-sealed chamber and a suction pump formed on the air exhaust pipe; an inert gas generating section for establishing an inert gas atmosphere in the air-sealed chamber, including an inert gas injection pipe disposed on the other side of the air-sealed chamber and an inert gas exhaust pipe disposed on the lower surface of the air-sealed chamber and provided with a switching valve; and a switching section for opening and closing a route for moving the uranium rod pulled down by the driving roller under the air-sealed chamber.

Further, the continuous casting apparatus may further comprise a shielding chamber including a hermetic connection pipe provided with a passage for the uranium rod under the air-sealed chamber and the switching section formed on the lower surface of the hermetic connection pipe, wherein the driving roller and the lower part of hermetic connection pipe are surrounded by the shielding chamber.

Further, the mold may comprise: a mold body including an inserting part inserted into a hole of the lower surface of the crucible, a heat insulating part formed integrally with the lower part of the inserting part, and an exhausting part vertically formed integrally with the lower part of the heat insulating part; a molding hollow vertically formed on the center of the mold body; and a silicon nitride tube attached to an inner wall of the molding hollow.

Further, the crucible and the mold may be surrounded with an adiabatic material made of graphite.

Further, the cooling section may comprise a cooling jacket surrounding the lower part of the mold, and cooling water flow tubes formed within the cooling jacket so as to provide cooling water.

Further, a start rod-supporter may be formed on a surface of the passage within the hermetic connection pipe, and a supporting rod may be disposed on a designated position of the side surface of the start rod-supporter and hydraulically operated.

Further, a switching door opened and closed by a hydraulic cylinder may be formed on the upper surface of the air-sealed chamber.

Further, the start rod may comprise an upper start rod including a fixing hole on its lower surface and a removable part formed on the upper surface of the fixing hole, and a lower start rod including on its upper surface a fixing protrusion inserted into the fixing hole of the upper start rod and fixed to the removable part of the upper start rod.

Further, the continuous casting apparatus may further comprise: a lower shielding chamber formed on the lower surface of the driving roller; and a cutting section including a fixing part for fixing the uranium rod pulled down into the lower shielding chamber, upper and lower cutting blades for cutting the uranium rod under the fixing part, and a spring for elastically returning the fixing part to its former position so as to repeatedly cut the uranium rod.

Further, the switching valve may comprise a high pressure-down pipe in a rectangular shape connected to the inert gas exhaust pipe within the shielding chamber and connected to an external device, and a weight switching part opened and closed by a conical bob with a designated weight formed on a tip of the inert gas exhaust pipe within the high pressure-down pipe.

Further, the switching section may comprise a hydraulic actuator installed on the lower surface of the hermetic connection pipe and hydraulically operated, and a lid operated by the hydraulic actuator.

Further, the continuous casting apparatus may further comprise a gas cooling section including an inert gas injection pipe disposed within the hermetic connection pipe, and a gas exhaust pipe formed on the lower surface of the hermetic connection pipe.

Further, the continuous casting apparatus may further comprise a local suction section including a suction device disposed near the switching section within the shielding chamber and having a plurality of suction holes, a flow tube with its one terminal connected to the back surface of the suction device, and a suction pump connected to the other terminal of the flow tube and formed outside the shielding chamber.

Further, the continuous casting apparatus may further comprise a supporting section including a supporter formed on the lower surface of the cooling jacket and provided with a vertical through hole at its center, and a bearing plate centrally supporting the supporter and disposed within the air-sealed chamber.

Further, the continuous casting apparatus may further comprise a cooling water volume controlling section controlling the cooling section to cool the uranium rod to a constant temperature and including thermocouples disposed within the mold, and a controller for controlling a cooling water volume of the cooling jacket according to the temperature sensed by the thermocouples.

Further, the continuous casting apparatus may further comprise a transferring section including a fracture part for fracturing the cut uranium rod formed under the cutting section, and a horizontal transferring part for horizontally transferring the cutted uranium rod.

Further, the continuous casting apparatus may further comprise a visual inspection section including a quartz pipe vertically formed on the vertical through hole under the supporter, and a transparent window formed on the air-sealed chamber corresponding to the quartz pipe.

Further, the continuous casting apparatus may further comprise a storage shed for storing the transferred uranium rod near the transferring section.

BRIEF DESCRIPTION OF THE DRAWINGS

The above and other objects, features and other advantages of the present invention will be more clearly understood from the following detailed description taken in conjunction with the accompanying drawings, in which:

FIG. 10*a* is a longitudinal-sectional view showing a step for forming a degree of vacuum;

FIG. 10*b* is a longitudinal-sectional view showing a step for forming an inert gas atmosphere;

FIG. 10*c* is a longitudinal-sectional view showing a step for coupling the start rod;

FIG. 10*d* is a longitudinal-sectional view showing a step for pulling down the start rod, thereby casting a uranium rod;

FIG. 10*e* is a longitudinal-sectional view showing a step for exhausting the cast uranium rod;

FIG. 10*f* is a longitudinal-sectional view showing a step for cutting the cast uranium rod; and FIG. 10*g* is a longitudinal-sectional view showing a step for transferring the uranium rod and storing the transferred uranium rod.

DESCRIPTION OF THE PREFERRED EMBODIMENTS

Now, preferred embodiments of the present invention will be described in detail with reference to the annexed drawings.

Figure 1:
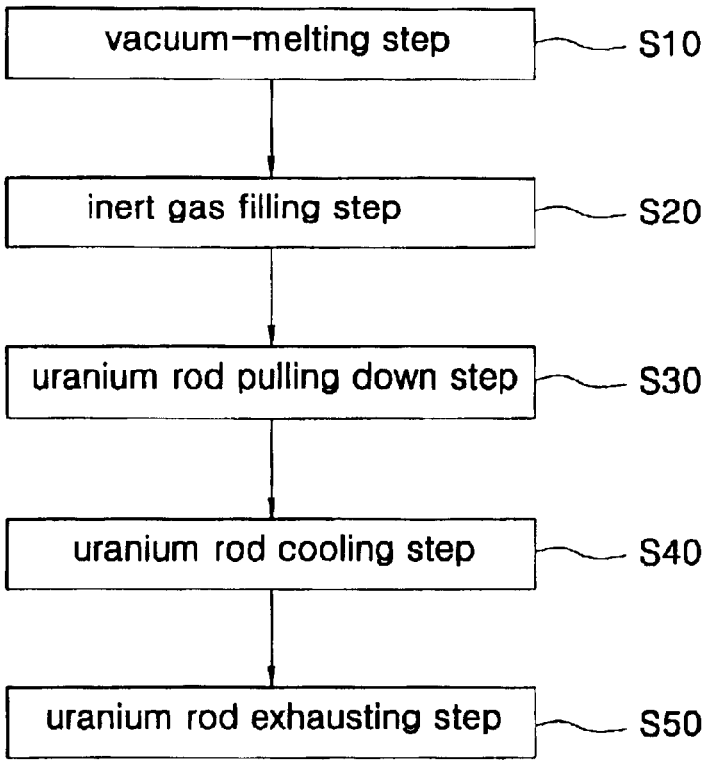
FIG. 1 is a block diagram showing a method for continuously casting a uranium rod in accordance with an embodiment of the present invention.

FIG. 1 is a block diagram showing a method for continuously casting a uranium rod in accordance with an embodiment of the present invention.

In order to continuously cast a metallic substance reduced from nuclear spent fuel into a degassed uranium rod, as shown in FIG. 1, the continuous casting method in accordance with this embodiment of the present invention comprises a vacuum-melting step (S10) for melting the metallic substance reduced from nuclear spent fuel in an air-sealed chamber under a vacuum condition, an inert gas filling step (S20) for reversing the vacuum condition of the air-sealed chamber and filling the air-sealed chamber with an inert gas, a uranium rod pulling down step (S30) for casting the molten metal into the uranium rod in the inert gas atmosphere and pulling down the uranium rod, a uranium rod cooling step (S40) for cooling the pulled down uranium rod, and a uranium rod exhausting step (S50) for exhausting the cooled uranium rod.

More particularly, in the vacuum-melting step (S10), the air-sealed chamber provided with a crucible is vacuumized using a suction pump. Under the vacuum condition, the crucible is heated by a high frequency induction coil. Then, the metallic substance reduced from nuclear spent fuel is melted within the crucible. Herein, impurities such as dust, radioactive gas, etc. generated in melting the metallic substance reduced from nuclear spent fuel are sucked and removed, and then the molten metal is degassed, thereby forming a degassed molten metal.

After the impurities are removed, the degassing is completed, and the metallic substance reduced from nuclear spent fuel is melted in the vacuum-melting step (S10), in the inert gas filling step (S20), the vacuum within the air-sealed chamber is reversed and the air-sealed chamber is filled with the inert gas. Herein, the oxidation of the uranium is prevented by injecting a small quantity of the inert gas.

After filling the air-sealed chamber with the inert gas in the inert gas filling step (20), in the uranium rod pulling down step (S30), the inert gas is continuously injected into the air-sealed chamber. Then, a start rod inserted into the mold of the air-sealed chamber under the inert gas atmosphere moves downward by a driving roller, thereby pulling down the uranium rod from the crucible filled with the molten metal. That is, the non-oxidized degassed uranium rod is pulled down from the crucible.

In the uranium rod cooling step (S40), the pulled down uranium rod is cooled by a cooling jacket installed around the pulled down uranium rod in the uranium rod pulling down step (S30). Thereby, the uranium rod in the molten state is cooled to form a solid uranium rod.

In the uranium rod-exhausting step (S50), the cooled uranium rod in the uranium rod-cooling step (S40) is exhausted into a shielding chamber. Herein, the shielding chamber is hermetically sealed. The radioactive gas exhausted along with the uranium rod is completely shielded by the shielding chamber.

Therefore, in the present invention, the metallic substance reduced from nuclear spent fuel is degassed, purified, and then melted. The non-oxidized molten metal is cast into the uranium rod, and the cast uranium rod is pulled down. The radioactivity generated from the pulled down uranium is shielded and the pulled down uranium rod is exhausted. That is, the molten metal is cast into a degassed uranium rod while securing the safety of work.

Figure 2:
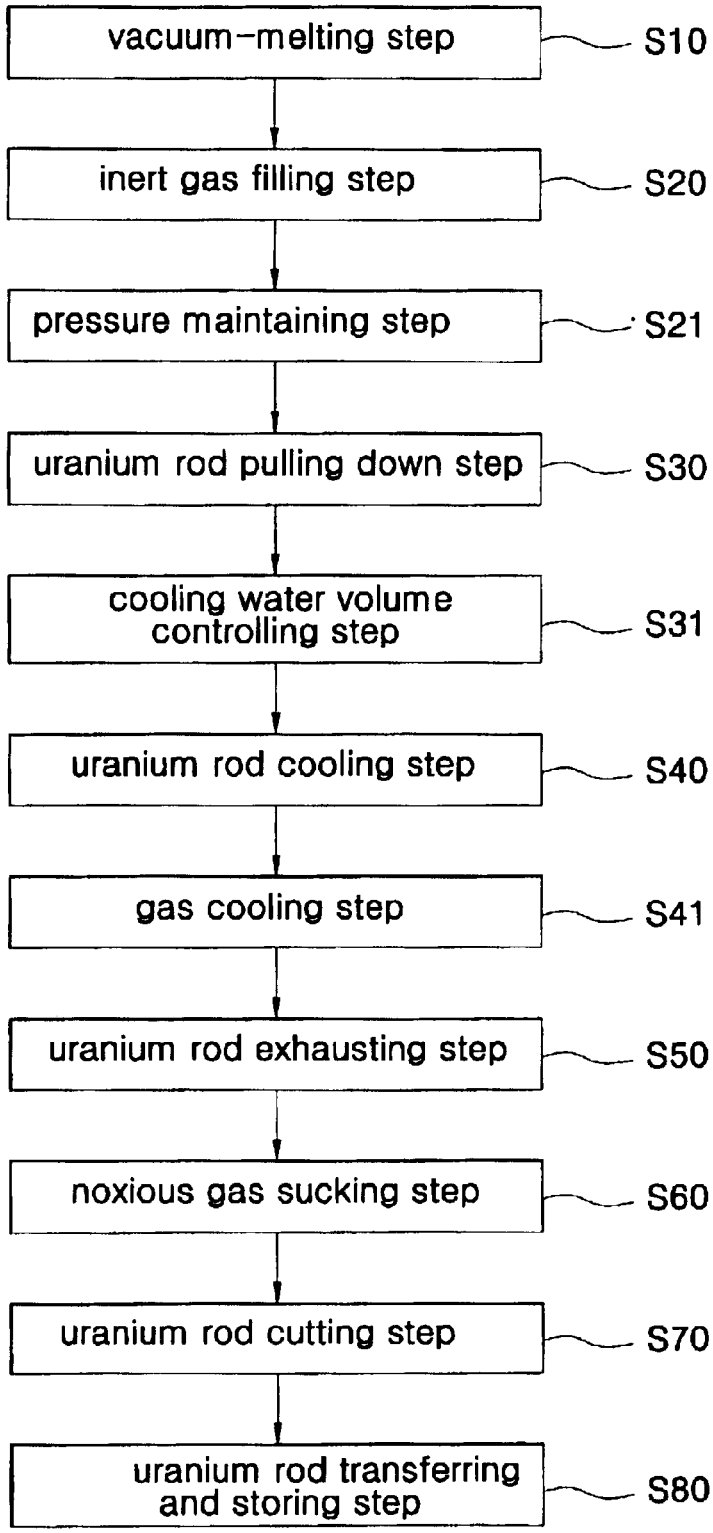
FIG. 2 is a block diagram showing a method for continuously casting a uranium rod in accordance with another embodiment of the present invention.

FIG. 2 is a block diagram showing a method for continuously casting a uranium rod in accordance with another embodiment of the present invention.

With reference to FIG. 2, the continuous casting method of this embodiment of the present invention comprises the vacuum-melting step (S10) for melting the metallic substance reduced from nuclear spent fuel in the air-sealed chamber under the vacuum condition, the inert gas filling step (S20) for reversing the vacuum condition of the air-sealed chamber and filling the air-sealed chamber with the inert gas, the uranium rod pulling down step (S30) for casting the molten metal into the uranium rod in the inert gas atmosphere and pulling down the uranium rod, the uranium rod cooling step (S40) for cooling the pulled down uranium rod, and the uranium rod exhausting step (S50) for exhausting the cooled uranium rod.

The continuous casting method of this embodiment of the present invention further comprises a pressure maintaining step (S21) between the inert gas filling step (S20) and the uranium rod pulling down step (S30), a cooling water volume controlling step (31) between the uranium rod pulling down step (S30) and the uranium rod cooling step (S40), a gas cooling step (S41) between the uranium rod cooling step (S40) and the uranium rod exhausting step (S50), a noxious gas sucking step (S60) after the uranium rod exhausting step (S50), a uranium rod cutting step (S70) after the noxious gas sucking step (S60), and a uranium rod transferring and storing step (S80) after the uranium rod cutting step (S70).

More particularly, in the pressure maintaining step (S21), when the inert gas injected into the air-sealed chamber in the inert gas filling step (S20) is under the high pressure, the inert gas is automatically exhausted to the outside, thereby maintaining a constant pressure of the inert gas within the air-sealed chamber. In this step, the air-sealed chamber is prevented from blowing up by the abnormally high temperature and pressure and from thereby leaking the radioactivity, after the vacuum within the air-sealed chamber is reversed and the inert gas is injected into the air-sealed chamber.

In the uranium rod pulling down step (S30), the start rod and the uranium rod is pulled down within a designated period by the driving roller under the inert gas atmosphere. Then, the pulling down of the start rod and the uranium rod is stopped within another designated period. That is, the steps of the pulling down of the start rod and the uranium rod and its stoppage are continuously repeated, thereby preventing the break-out of the uranium rod due to the violent pulling down.

In the cooling water volume controlling step (S31) between the uranium rod pulling down step (S30) and the uranium rod cooling step (S40), the temperature of the mold is sensed, and the cooling water volume is controlled according to the sensed temperature of the mold, thereby cooling the uranium rod to a constant temperature and preventing the break-out of the uranium rod due to the sudden temperature difference.

In the gas cooling step (S41) between the uranium rod cooling step (S40) and the uranium rod exhausting step (S50), the above-described uranium rod first-cooled by the cooling water is secondarily and completely cooled by the inert gas. Herein, before the uranium rod is exhausted, the uranium rod is cooled to less than 200° C., thereby preventing the uranium rod from being oxidized in the atmosphere.

In the noxious gas sucking step (S60) after the uranium rod exhausting step (S50), a local suction device is installed around the uranium rod pulled down into the shielding chamber, thereby locally and completely sucking noxious gas which can be exhausted along with the uranium rod. As a result, the safety of the work is further improved.

In the uranium rod-cutting step (S70), the exhausted uranium rod is cut to a designated length. Herein, the pulled down uranium rod is cut to a desired length, thereby not interfering with the pulling down of the continuous cast uranium rod.

Finally, in the uranium rod transferring and storing step (S80), the uranium rod cut in the uranium rod cutting step (S70) is cutted, and the cutted uranium rod is transferred and stored in a storage shed. Herein, the uranium rod produced by the continuous casting is automatically cut within the shielding chamber and stored in the storage shed.

Therefore, the aforementioned continuous casting method of this embodiment of the present invention prevents the air-sealed chamber from blowing up by the high pressure of the inert gas and minimizes the break-out of the uranium rod generated in the uranium pulling down and cooling steps. Further, this continuous casting method prevents the oxidation of the exhausted uranium rod and sucks the noxious gas, thereby maximizing the safety of the work. Moreover, this continuous casting method cuts the produced uranium rod, and transfers and stores the cut uranium rods by remote control.

Figure 3:
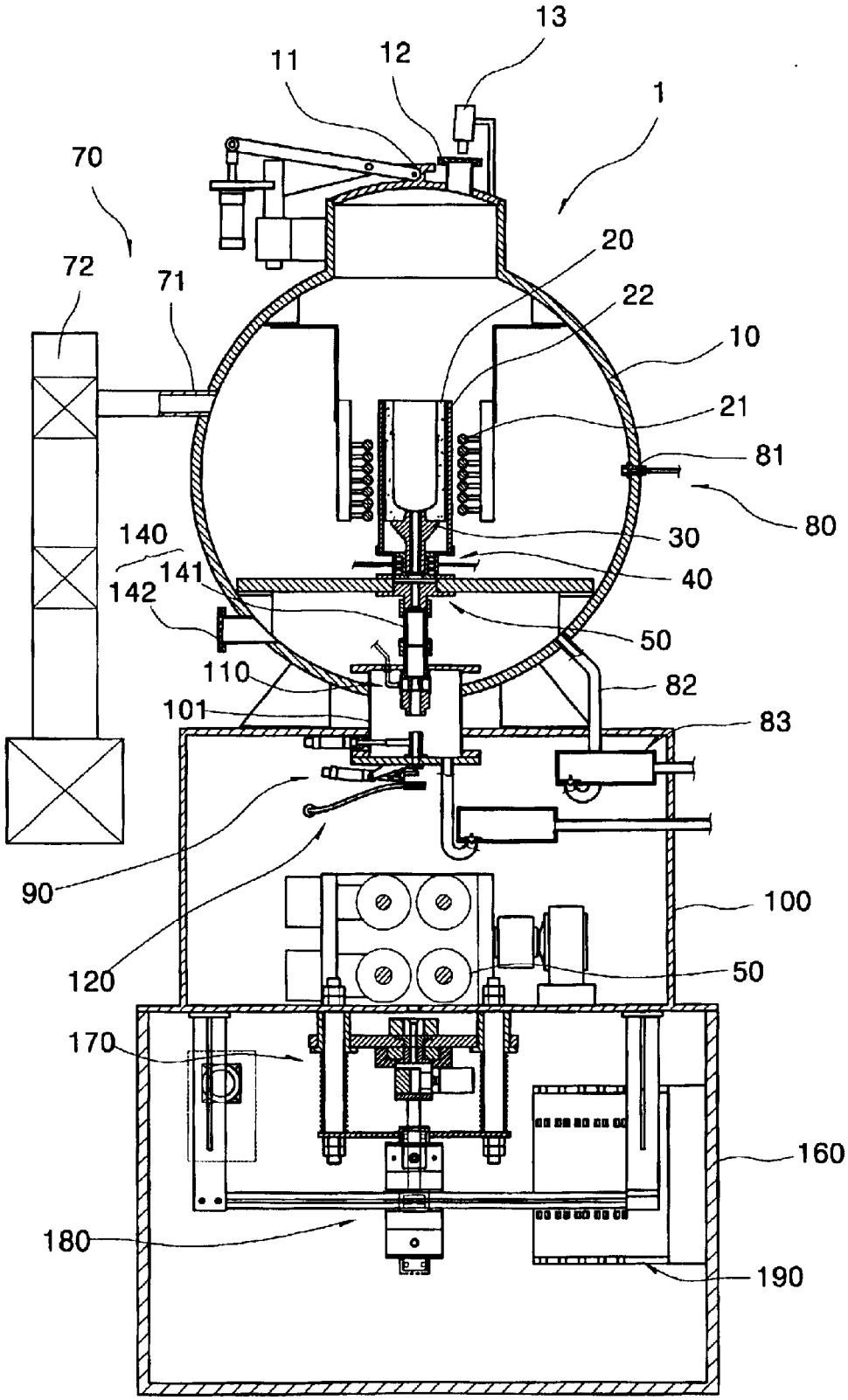
FIG. 3 is a longitudinal-sectional view of an apparatus for continuously casting a uranium rod in accordance with the present invention.

FIG. 3 is a longitudinal-sectional view of an apparatus for continuously casting a uranium rod in accordance with the present invention.

As shown in FIG. 3, the apparatus 1 for continuously casting the uranium rod of the present invention comprises an air-sealed chamber 10, a crucible 20, a mold 30, and a cooling section 40. The crucible 20 is installed within the air-sealed chamber 10 and surrounded by a high frequency induction coil 21. The mold 30 is disposed below the crucible 20, and the cooling section 40 is disposed below the mold 30. The crucible 20 and the mold 30 are coated with an adiabatic material 22. A supporting section 130 is disposed below the cooling section 40.

A hermetic connection pipe 101 is connected to the lower surface of the air-sealed chamber 10. A shielding chamber 100 is disposed under the hermetic connection 101 so that a driving roller 50 is surrounded by the shielding chamber 100. A gas cooling section 110 is disposed within the hermetic connection pipe 101. A switching section 90 is formed on the lower surface of the hermetic connection pipe 101. A local suction section 120 is disposed within the shielding chamber 100 so as to correspond to the switching section 90.

A vacuum generating section 70 for forming vacuum is formed on a side of the air-sealed chamber 10. A inert gas generating section 80 for injecting inert gas is formed on the other side of the air-sealed chamber 10.

The air-sealed chamber 10 is a chamber for forming a vacuum condition in the crucible 20 during melting the metallic substance reduced from nuclear spent fuel within the crucible 20. A switching door 11 formed on the upper surface of the air-sealed chamber 10 serves to remotely allow the metallic substance reduced from nuclear spent fuel being a high-level radioactive substance to flow into the crucible 20.

A transparent window 12 and a pyrometer, formed on a side of the switching door 11, measure the temperature of a molten metal formed by melting the metallic substance reduced from nuclear spent fuel within the crucible 20 using the high frequency induction coil 21 surrounding the crucible 20 and control the high frequency induction coil 21, thereby maintaining the temperature of the molten metal.

The vacuum generating section 70 comprises an air exhaust pipe 71 and a suction pump 72. The air exhaust pipe 71 is disposed on a side of the air-sealed chamber 10. The suction pump 72 is disposed outside the air exhaust pipe 71. The air-sealed chamber 10 is maintained under a constant degree of vacuum by the strong suction of the suction pump 72, thereby easily purifying and degassing the molten metal of the metallic substance and thus forming degassed molten uranium.

The inert gas generating section 80 comprises an inert gas injection pipe 81, an inert gas exhaust pipe 82, and a switching valve 83. The inert gas injection pipe 81 is disposed on the other side of the air-sealed chamber 10. A terminal of the inert gas exhaust pipe 82 is connected to the lower surface of the air-sealed chamber 10. The switching valve 83 is formed on the other terminal of the inert gas exhaust pipe 82. After melting the metallic substance reduced from nuclear spent fuel under the vacuum condition, the vacuum within the crucible 20 is reversed and the inert gas is injected into the air-sealed chamber 10 via the switching valve 83.

When the air-sealed chamber 10 is filled with the inert gas and maintains a constant pressure, the molten metal is cast into the uranium rod. Therefore, the oxidation of the uranium rod is completely prevented.

The crucible 20 is formed as a hollow cylinder. The upper surface of the crucible 20 is opened and the lower surface of the crucible 20 is provided with the mold 30. The mold 30 is inserted into the lower surface of the crucible 20, and the cooling section 40 is formed under the mold 30.

Herein, the crucible 20 serves as a space where the metallic substance reduced from nuclear spent fuel is melted by the high frequency induction coil 21. The mold 30 serves to mold the molten metal into the uranium rod. The cooling section 40 serves to cool and harden the molded uranium rod.

The crucible 20 and the mold 30 are surrounded with the adiabatic material 22 made of graphite. Therefore, when the molten metal is pulled down from the crucible 20 to the mold 30, the adiabatic material 22 maintains the temperature within the crucible 20 and the mold 30, thereby preventing the breakout of the uranium rod due to the temperature difference.

The supporting section 130 is formed on the lower surface of the cooling section 40. In the air-sealed chamber 10, the supporting section 130 serves to support the crucible 20, the mold 30, and the cooling section 40.

A visual inspection section 140 comprises a quartz pipe 141 and a transparent window 142. The quartz pipe 141 is formed on the lower surface of the supporting section 130. The transparent window 142 is formed in the air-sealed chamber 10. Herein, the transparent window 142 of the air-sealed chamber 10 corresponds to the quartz pipe 141, thereby showing the quartz pipe 141. Through the visual inspection section 140, a worker can visually inspect the uranium rod pulled down into the quartz pipe 141. When the worker finds defective uranium rods or the break-out of the uranium rods, he/she stops the operation of the continuous casting apparatus 1.

The hermetic connection pipe 101 serves as a space where the cast uranium rod is transferred from the air-sealed chamber 10 to the shielding chamber 100. The cast uranium rod is completely cooled by the gas cooling section 110 within the hermetic connection pipe 101, thereby being prevented from oxidizing in the atmosphere.

The switching section 90 connected to the lower surface of the hermetic connection pipe 101 serves to hermetically seal the hermetic connection pipe 101 and the air-sealed chamber 10, thereby forming a proper degree of vacuum.

The shielding chamber 100 serves as a barrier for shielding the radioactivity generated from the cast uranium rod pulled down by the driving roller 50.

The local suction section 120 formed within the shielding chamber 10 serves to locally and completely suck the noxious gas exhausted along with the uranium rod.

The driving roller 50 serves to pull down the cast uranium rod. Herein, the uranium rod is pulled down within a designated period and then stops within another designated period. That is, the uranium rod goes through a repeated series of cycles including the pulling down and its stoppage by a known control box, thereby preventing the break-out of the uranium rod due to the excessive pulling down force.

A lower shielding chamber 160 is connected to the lower surface of the driving roller 50. A cutting section 170, a transferring section 180, and a storage shed 190 are formed within the lower shielding chamber 160.

Herein, the lower shielding chamber 160 serves as a barrier for shielding the noxious gas and the radioactivity generated from the uranium rod cut by the cutting section 170.

The cutting section 170 cuts the uranium rod produced by the continuous casting and pulled down by the driving roller 50 in a designated length so that the cutting does not prevent the pulling down of the uranium rod.

The transferring section 180 serves to transfer the cut uranium rod by the cutting section 170 into the storage shed 190.

Within the lower shielding chamber 160, the storage shed 190 stores the cut uranium rod.

Therefore, in the aforementioned continuous casting apparatus 1, impurities generated in melting the metallic substance reduced from nuclear spent fuel are easily removed, the molten metal is easily degassed, the oxidation of uranium is prevented, and the residue of the molten metal does not remain in the crucible. AS a result, the aforementioned continuous casting apparatus 1 continuously and easily casts a degassed uranium rod, pulls down the cast uranium rod, and cuts, transfers, and stores the uranium rod by remote control.

Figure 4:
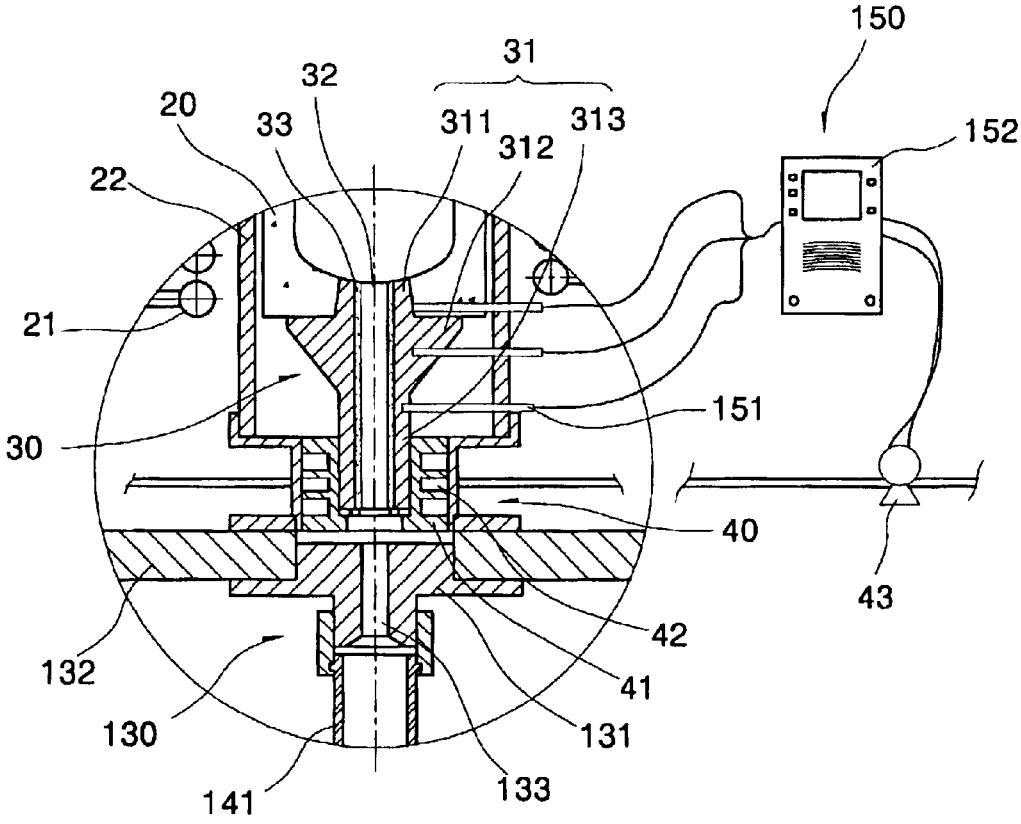
FIG. 4 is an enlarged longitudinal-sectional view of the apparatus for continuously casting a uranium rod in accordance with the present invention.

FIG. 4 is an enlarged longitudinal-sectional view of the apparatus for continuously casting a uranium rod in accordance with the present invention.

FIG. 4 shows the longitudinal sections of the mold 30, the cooling section 40, and the supporting section 130. As shown in FIG. 4, the crucible 20 is surrounded by the high frequency induction coil 21, and the mold 30 is inserted into the lower surface of the crucible 20. The crucible 20 including the upper part of the mold 30 is coated with the adiabatic material 22. The cooling section 40 is formed on the lower surface of the mold 30, and the supporting section 130 is formed on the lower surface of the cooling section 40.

Herein, the mold 30 comprises a mold body 31, a molding hollow 32, and a silicon nitride tube 33. The mold body 31 comprises an inserting part 311, a heat insulating part 312, and an exhausting part 313. The inserting part 311, the heat insulating part 312, and the exhausting part 313 are successively and vertically disposed. The molding hollow 32 is vertically formed on the center of the mold body 31. The silicon nitride tube 33 is formed on an inner wall of the molding hollow 32.

The inserting part 311 serves to insert the mold 30 into the lower surface of the crucible 20. The heat insulating part 312 serves to maintain the temperature of the molten uranium exhausted from the crucible 20 via the silicon nitride tube 33. The exhausting part 313 is inserted into the cooling section 40.

The molten metal is molded into the uranium rod via the molding hollow 32. The silicon nitride tube 33 serves as an antifriction layer for reducing friction with the surface of the uranium rod, thereby forming a smooth outer surface of the cast uranium rod.

The cooling section 40 comprises a cooling jacket 41, cooling water flow tubes 42, and a feed water pump 43. The cooling jacket 41 is connected to the exhausting part 313 of the mold 30. The cooling water flow tubes 42 are formed within the cooling jacket 41. Via the cooling water flow tubes 42, the cooling water from the feed water pump 43 is provided to the inside of the cooling jacket 41, thereby cooling the uranium rod pulled down via the exhausting part 313.

The crucible 20 and the mold 30, disposed above the cooling section 40, are surrounded with the adiabatic material 22. The adiabatic material 22 serves to maintain the temperature of the molten metal introduced into the mold 30 from the crucible 20, thereby preventing the break-out of the uranium rod due to the temperature difference.

The supporting section 130 comprises a supporter 131, a bearing plate 132, and a vertical through hole 133. The supporter 131 is formed on the lower surface of the cooling jacket 41 and provided with the vertical through hole 132 at its center. The bearing plate 132 is formed on the outer surface of the supporter 131, thereby supporting the crucible 20, the mold 30, and the cooling section 40.

A cooling water volume controlling section 150 comprises a plurality of thermocouples 151 and a controller 152. The thermocouples 151 are formed on one side of the mold 30. The controller 152 is electrically connected to the thermocouples 151.

Herein, the controller 152 measures the temperature of the thermocouples 151, thereby controlling the flow rate of the feed water pump 43. As a result, the cooling water volume controlling section 150 controls the cooling section 40 to cool the uranium rod to a constant temperature.

That is, in case the temperature of the molten metal introduced via the mold 30 is much higher than a designated temperature, the controller 152 senses the temperature of the molten metal by the thermocouples 151 and increases the flow rate of the feed water pump 43, thereby cooling the molten metal to the designated temperature. On the other hand, in case the temperature of the molten metal introduced via the mold 30 is slightly higher than the designated temperature, the controller 152 senses the temperature of the molten metal by the thermocouples 151 and decreases the flow rate of the feed water pump 43, thereby cooling the molten metal to the designated temperature.

That is, the cooling water volume controlling section 150 cools the uranium to the designated temperature, thereby preventing the break-out of the uranium rod due to the temperature difference.

Therefore, the continuous casting apparatus of the present invention continuously casts the molten metal into a uranium rod with a smooth and perfect surface and without break-out.

Figure 5:
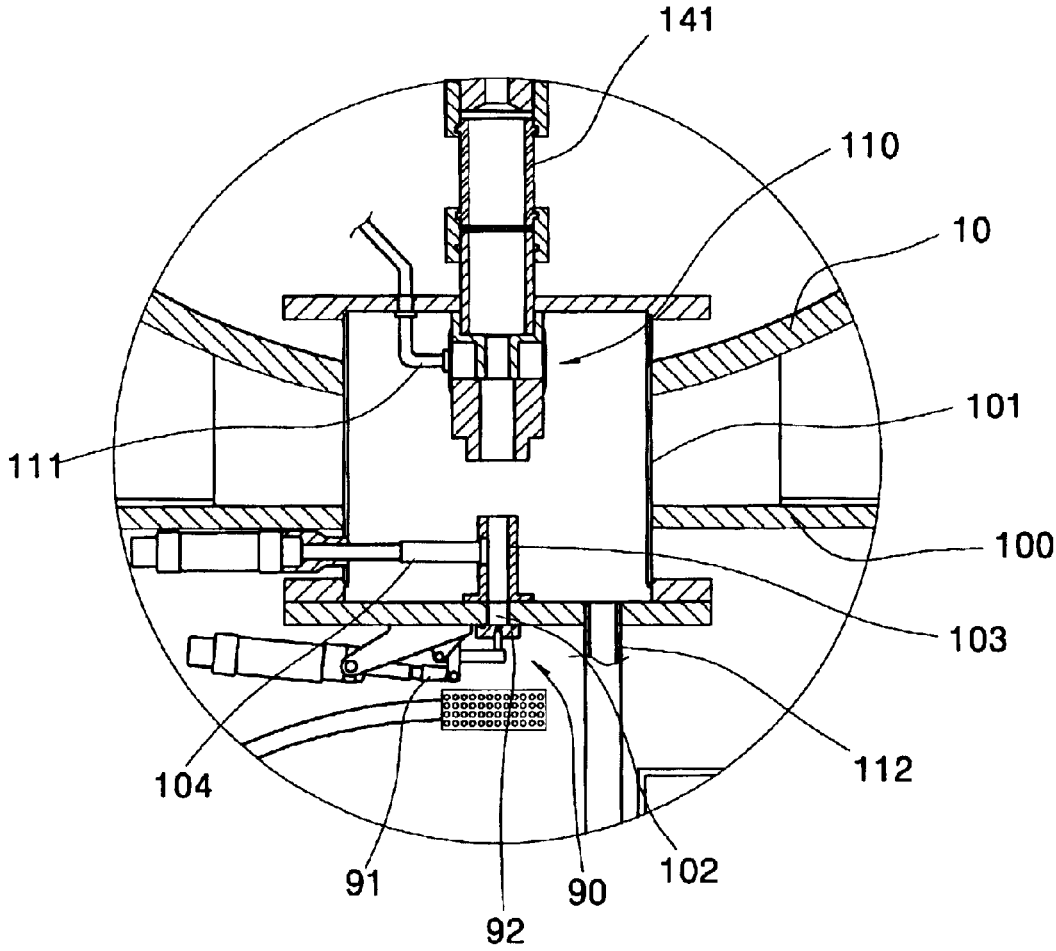
FIG. 5 is a further enlarged longitudinal-sectional view of the apparatus for continuously casting a uranium rod in accordance with the present invention.

FIG. 5 is an enlarged longitudinal-sectional view of the continuous casting apparatus in accordance with the present invention.

FIG. 5 shows the longitudinal section of the hermetic connection pipe 101 disposed between the air-sealed chamber 10 and the shielding chamber 100. As shown in FIG. 5, the hermetic connection pipe 101 comprises the gas cooling section 110, a start rod-supporter 103, a supporting rod 104, a passage 102, and the switching section 90. The gas cooling section 110 is formed on the upper part of the inside of the hermetic connection pipe 101. The start rod-supporter 103 is formed on the lower part of the inside of the hermetic connection pipe 101. The supporting rod 104 is disposed on a designated position of the side surface of the start rod-supporter 103. The passage 102 is formed on the center of the lower surface of the hermetic connection pipe 101 corresponding to the start rod-supporter 103. The switching section 90 is formed on the lower surface of the hermetic connection pipe 101.

The gas cooling section 110 comprises an inert gas injection pipe 111 and a gas exhaust pipe 112. The gas cooling section 110 cools the uranium rod pulled down into the hermetic connection pipe 101 to less than 200° C. by injecting the inert gas to the uranium rod via the inert gas injection pipe 111, thereby preventing the oxidation of the uranium rod in the atmosphere.

The gas exhaust pipe 112 serves to exhaust the inert gas injected from the hermetic connection pipe 101 to the outside.

The start rod-supporter 103 fixes an upper start rod (not shown) inserted into the lower surface of the crucible 20 at the early stage of the work by engaging the hydraulically actuated supporting rod 104 with the upper start rod.

The switching section 90 comprises a hydraulic actuator 91 and a lid 92. The lid 92 is operated by the hydraulic actuator 91, thereby opening and closing the passage 102. At the early stage of the work, the air-sealed chamber 10 and the hermetic connection pipe 101 are hermetically sealed by the lid 92, thereby forming a designated degree of vacuum.

Therefore, in the aforementioned continuous casting apparatus of the present invention, after the uranium rod is cooled by the gas cooling section 110 so that the oxidation of the uranium rod is prevented, a proper degree of vacuum is formed by the switching section 90.

Figure 6:
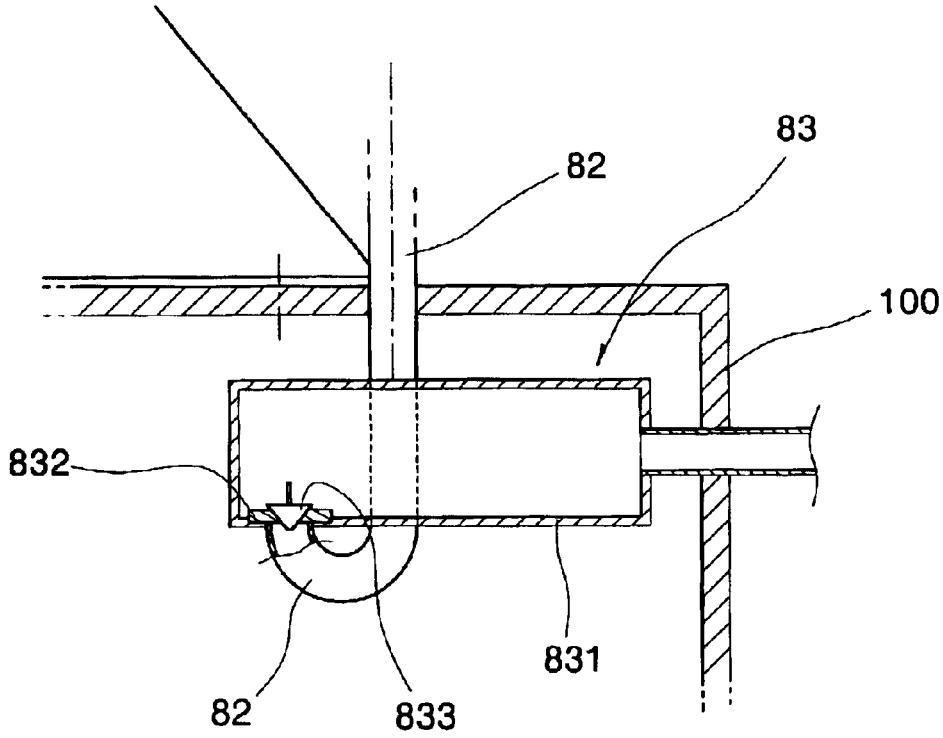
FIG. 6 is another enlarged longitudinal-sectional view of the apparatus for continuously casting a uranium rod in accordance with the present invention.

FIG. 6 is an enlarged longitudinal-sectional view of the continuous casting apparatus in accordance with the present invention.

FIG. 6 shows the longitudinal section of the switching valve 83 of the inert gas exhaust pipe 82. As shown in FIG. 6, the inert gas exhaust pipe 82 is disposed within the shielding chamber 100, and the switching valve 83 is formed on one terminal of the inert gas exhaust pipe 82 within the shielding chamber 100.

More particularly, the switching valve 83 comprises a high pressure-down pipe 831 in a rectangular shape, a weight switching part 832, and a conical bob 833. The high pressure-down pipe 831 protrudes from the shielding chamber 100 and is connected to an external device. The weight switching part 832 is opened and closed by the conical bob 833 with a designated weight. The conical bob 833 is formed on a tip of the inert gas exhaust pipe 82 within the high pressure-down pipe 831.

Herein, the switching valve 83 serves to automatically exhaust the inert gas, when the inert gas filling the air-sealed chamber (not shown) has a designated pressure.

The high pressure-down pipe 831 is opened to the outside when the inert gas at high temperature and pressure is suddenly exhausted, thereby preventing the leakage of radioactivity and noxious gas due to the fracture of the inert gas exhaust pipe 82.

The high pressure-down pipe 831 is formed within the shielding chamber 100. Therefore, the opening of the high pressure-down pipe 831 to the outside minimizes a risk of leakage accidents.

When the inert gas introduced via the inert gas exhaust pipe 82 is more than a designated pressure, the conical bob 833 of the weight switching part 832 is elevated, thereby exhausting the inert gas into the high pressure-down pipe 831.

Preferably, the aforementioned switching valve 83 comprises a gas exhaust pipe (not shown), thereby effectively preventing the leakage of the noxious gas due to the abnormally high pressure.

Therefore, the continuous casting apparatus of the present invention safely and effectively exhausts the inert gas via the switching valve 83.

Figure 7:
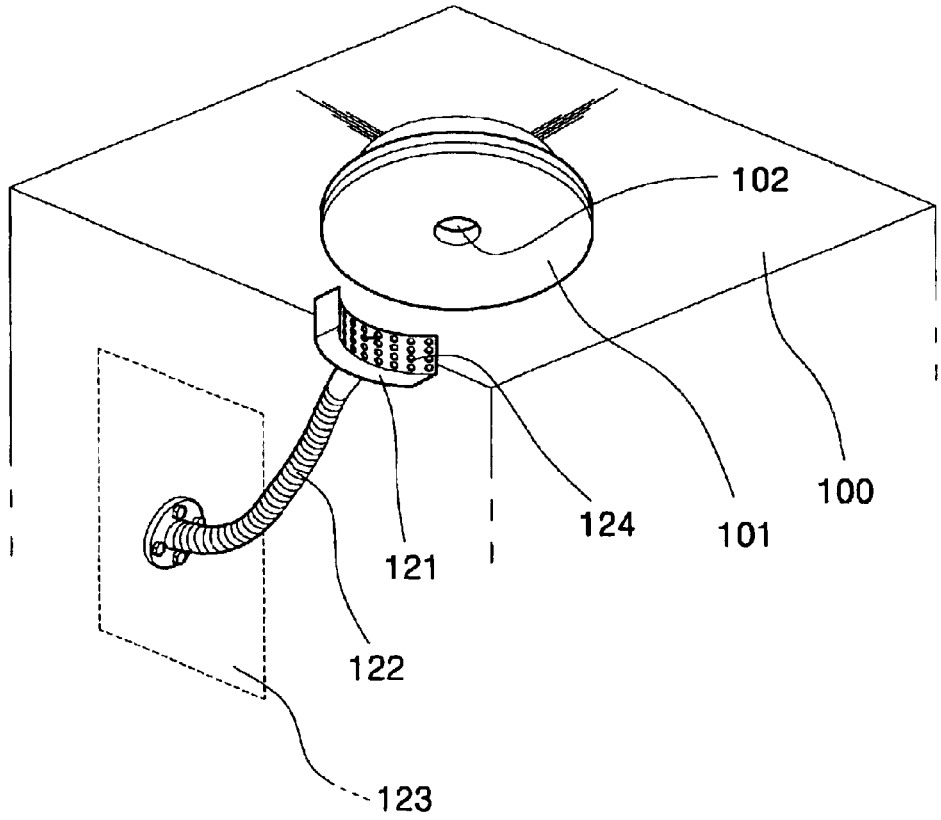
FIG. 7 is an enlarged perspective view of the apparatus for continuously casting a uranium rod in accordance with the present invention.

FIG. 7 is an enlarged perspective view of the apparatus for continuously casting a uranium rod in accordance with the present invention.

FIG. 7 shows the local suction section 120 formed within the shielding chamber 100. As shown in FIG. 7, the local suction section 120 is installed on one side of the lower surface of the passage 102 on the lower surface of the hermetic connection pipe 101 formed on the upper part of the shielding chamber 100.

More particularly, the local suction section 120 comprises a suction device 121, a flow tube 122, and a suction pump 123. The suction device 121 is disposed below the passage 102 and comprises a plurality of suction holes 124. A terminal of the flow tube 122 is connected to the back surface of the suction device 121. The suction pump 123 is connected to the other terminal of the flow tube 122 and formed outside the shielding chamber 100.

Herein, the local suction section 120 serves to locally suck the noxious gas exhausted along with the pulled down uranium rod via the passage 102 of the hermetic connection pipe 101.

The local suction section 120 allows a worker to be close to the shielding chamber 100 and completely prevents the leakage of the noxious gas, thereby users safely operating the continuous casting apparatus.

Figure 8:
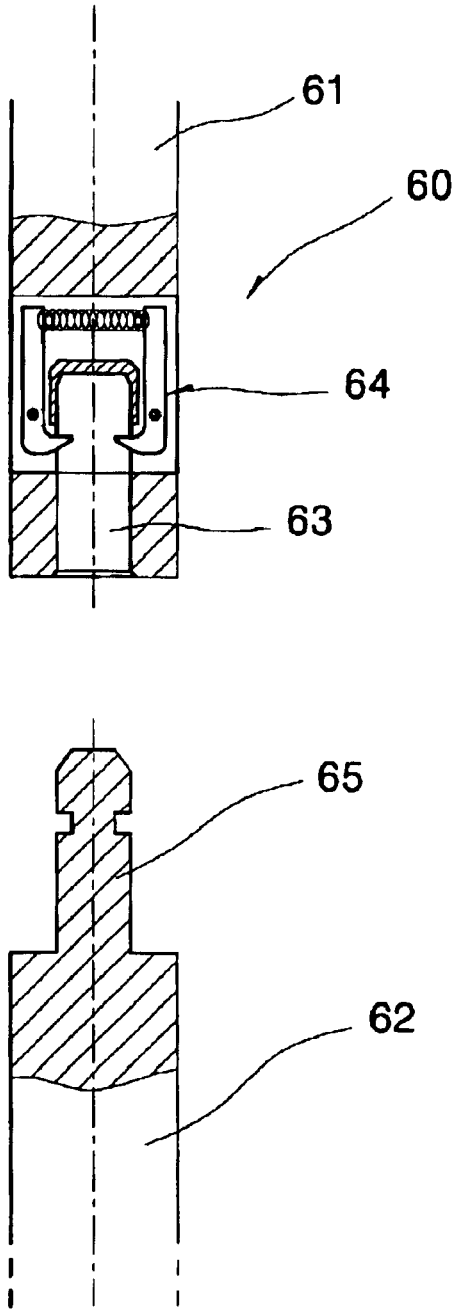
FIG. 8 is a longitudinal-sectional view of a start rod of the apparatus for continuously casting a uranium rod in accordance with the present invention.

FIG. 8 is a longitudinal-sectional view of the start rod of the apparatus for continuously casting a uranium rod in accordance with the present invention.

As shown in FIG. 8, the start rod 60 comprises an upper start rod 61 and a lower start rod 62. The upper start rod 61 includes a fixing hole 63 on its lower surface and a removable part 64 formed on the upper surface of the fixing hole 63. The lower start rod 62 includes a fixing protrusion 65 on its upper surface. The fixing protrusion 65 of the lower start rod 62 is inserted into the fixing hole 63 of the upper start rod 61 and fixed to the removable part 64 of the upper start rod 61.

Herein, the upper start rod 61 is introduced into the air-sealed chamber (not shown) at the early stage of work, and serves to close the lower surface of the crucible (not shown).

Further, the lower start rod 62 is coupled with the lower surface of the upper start rod 61, and serves to pull down the uranium rod along with the upper start rod 61, thereby casting the molten metal into the uranium rod.

The removable part 64 serves to elastically fix the fixing protrusion 65 inserted into the fixing hole 63, and to allow the worker to easily release the fixing protrusion 65 from the fixing hole 63 after the uranium rod is continuously cast and pulled down.

A contact region of the upper start rod 61, which touches the molten metal, is made of insoluble and non-oxidizable material. Therefore, the contact region of the upper start rod 61 is not melted and not oxidized by the molten uranium.

The start rod 60 comprises two parts, i.e., the upper and lower start rods 61 and 62, coupled and engaged with each other, thereby easily forming a degree of vacuum in the continuous casting and properly pulling down the uranium rod.

Figure 9:
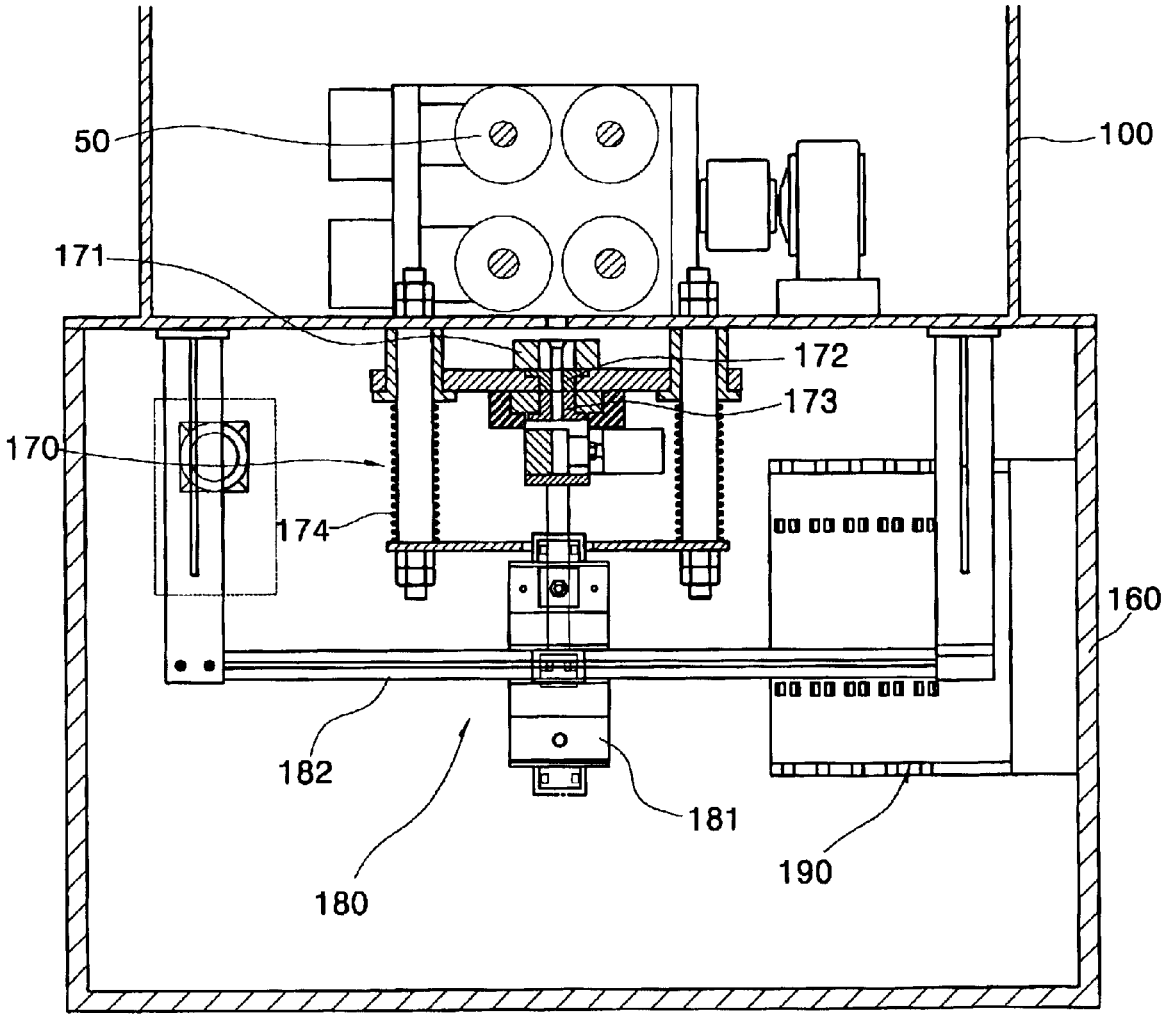
FIG. 9 is an enlarged longitudinal-sectional view of a cutting section and a transferring section of the apparatus for continuously casting a uranium rod in accordance with the present invention.

FIG. 9 is an enlarged longitudinal-sectional view of the cutting section and the transferring section of the apparatus for continuously casting a uranium rod in accordance with the present invention.

As shown in FIG. 9, the cutting section 170 comprises a fixing part 171, an upper cutting blade 172, a lower cutting blade 173, and a spring 174. The fixing part 171 fixes the pulled down uranium rod into the lower shielding chamber 160 formed under the shielding chamber 100. The upper and lower cutting blades 172 and 173 are formed under the fixing part 171 and cut the uranium rod. The spring 174 serves to elastically return the fixing part 171 to its former position.

The transferring section 180 is formed below the cutting section 170, and comprises a fracture part 181 and a horizontal transferring part 182. The fracture part 181 fractures the cut uranium rod. The horizontal transferring part 182 horizontally transfers the cutted uranium rod. The storage shed 190 is formed near the transferring section 180 and serves to store the transferred uranium rod.

Herein, the fixing part 171 fixes the uranium rod pulled down by the driving roller 50, and downwardly moves the cutting section 170 along with the uranium rod by the force generated by the pulling-down of the uranium rod.

The upper and lower cutting blades 172 and 173 downwardly move along with the uranium rod by the fixing part 171. At this time, the lower cutting blade 173 hydraulically moves and cuts the uranium rod.

The spring 174 moves down along with the uranium rod by the fixing part 171. Then, when the fixing part 171 is disengaged from the upper and lower cutting blades 172 and 173 after the cutting of the uranium rod, the fixing part 171 returns to its former position by an elastic force of the spring 174, thereby repeatedly cutting the uranium rod.

The fracture part 181 serves to fracture the uranium rod cut by the cutting section 170, and the horizontal transferring part 182 serves to transfer the uranium rod cutted by the fracture part 181 into the storage shed 190.

Therefore, the continuous casting apparatus of the present invention repeatedly cuts the cast uranium rods, transfers and stores the cut uranium rods, thereby casting and storing the uranium rods by remote control.

FIGS. 10*a* to 10*g* show a process for operating the apparatus for continuously casting a uranium rod in accordance with the present invention.

Figure 10A:
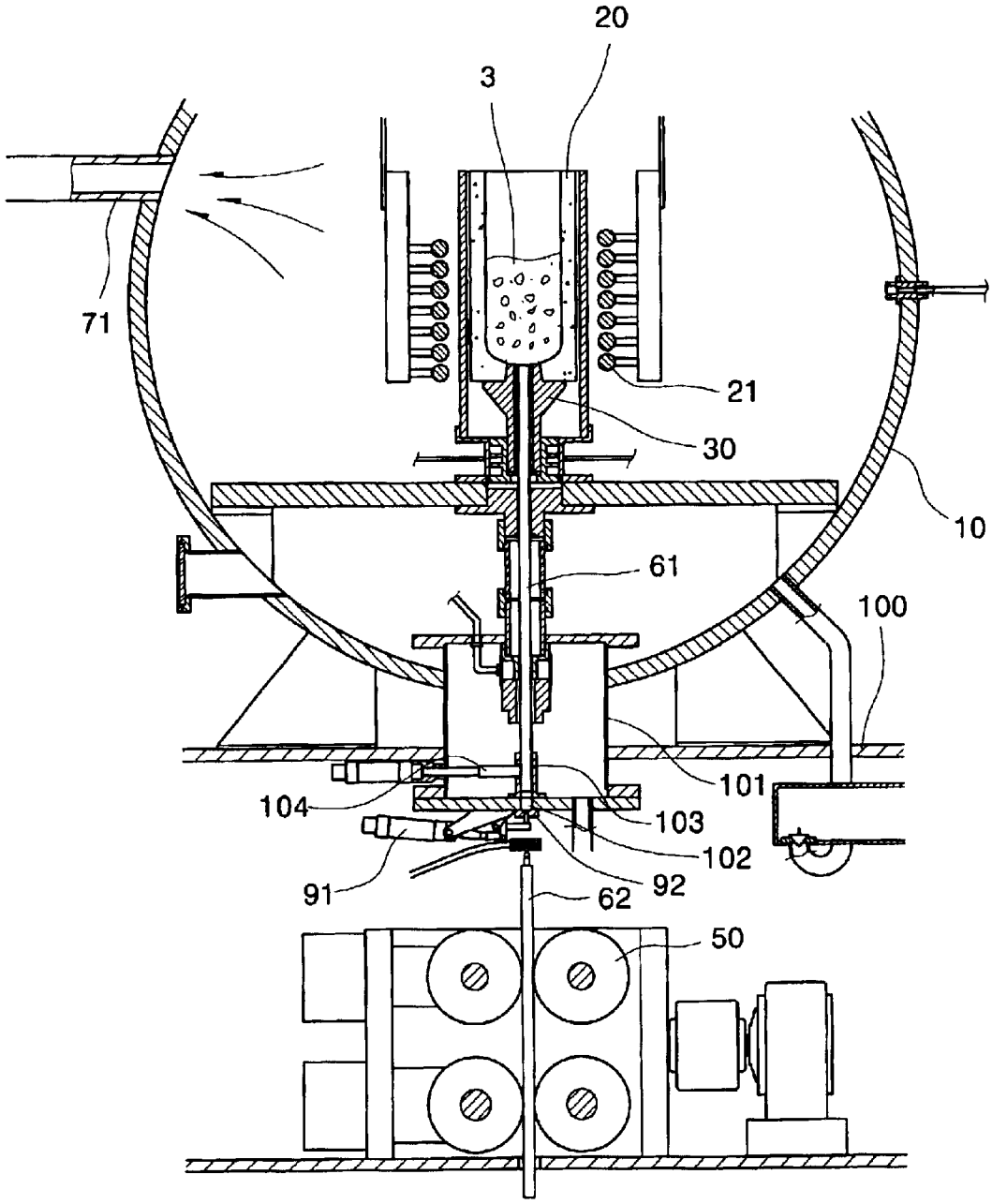
FIGS. 10*a* to 10*g* show a process for operating the apparatus for continuously casting a uranium rod of the present invention, and more particularly.
Figure 10B:
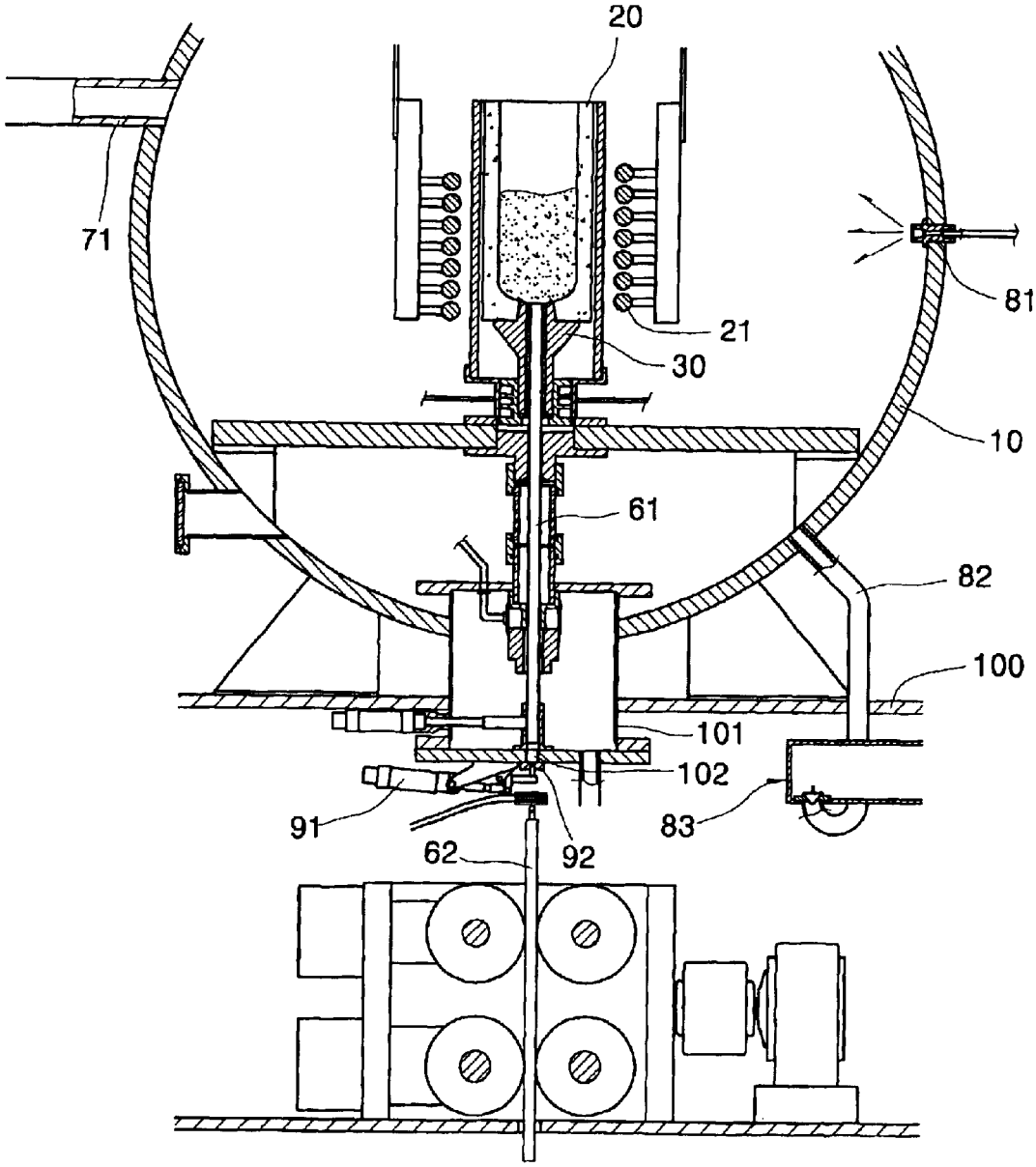
Figure 10C:
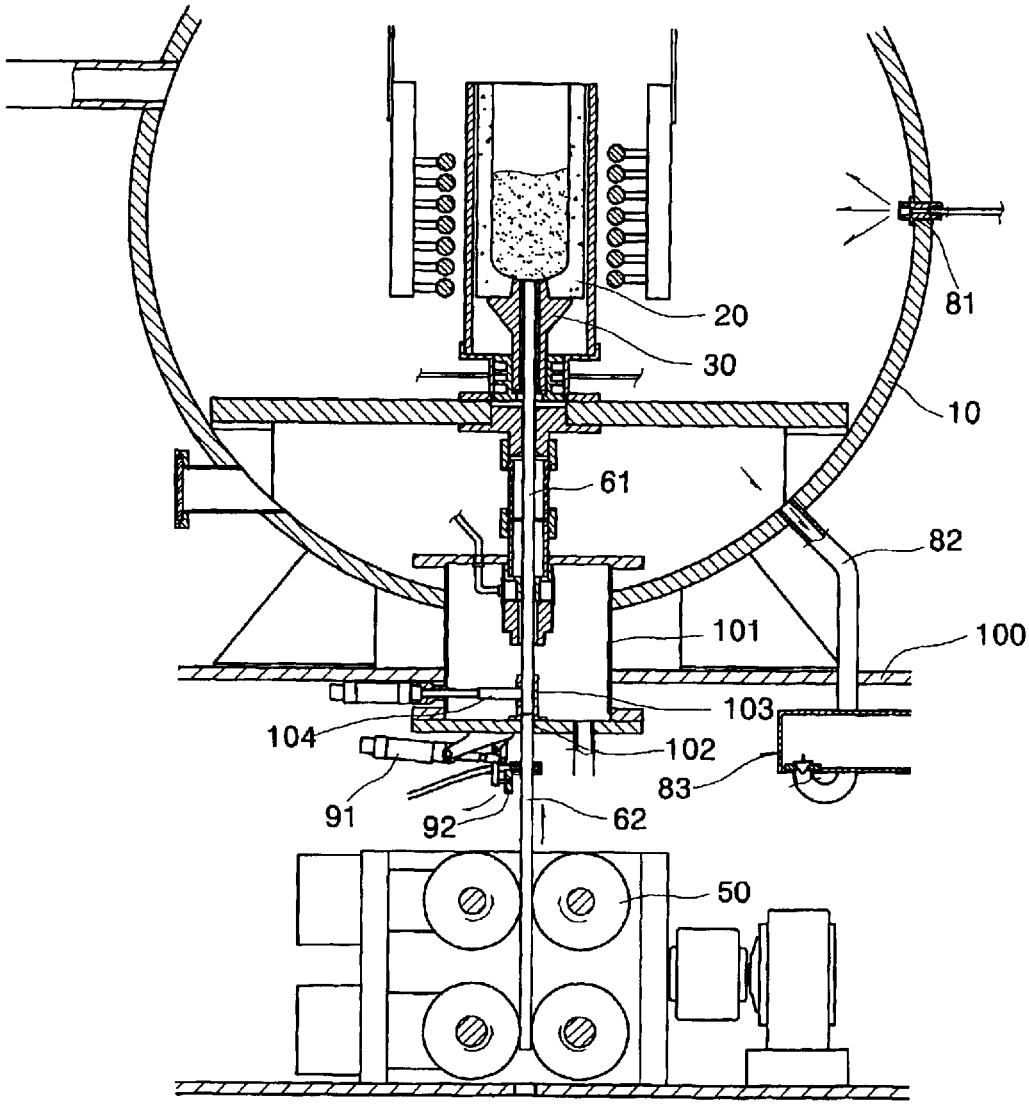
Figure 10D:
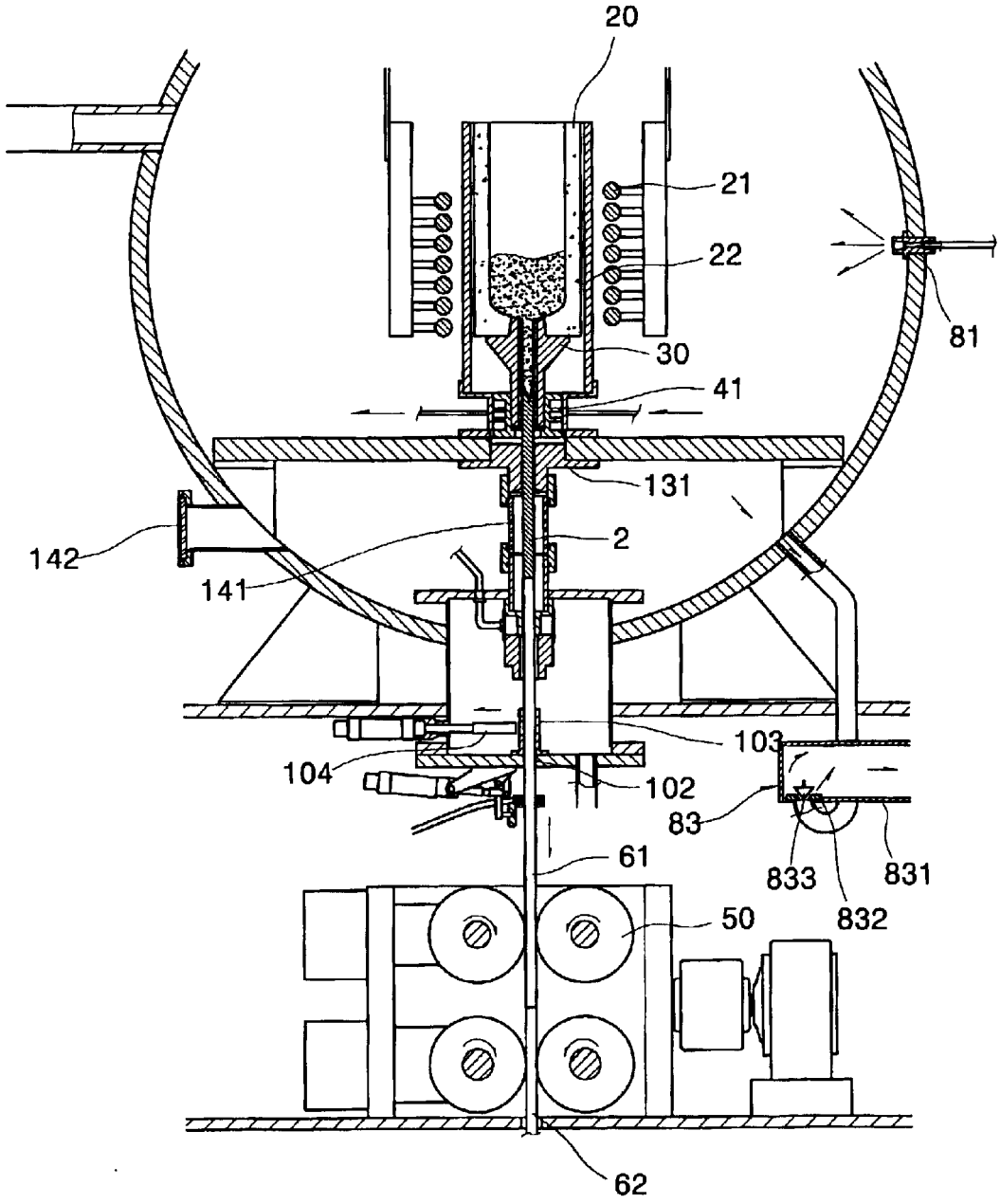
Figure 10E:
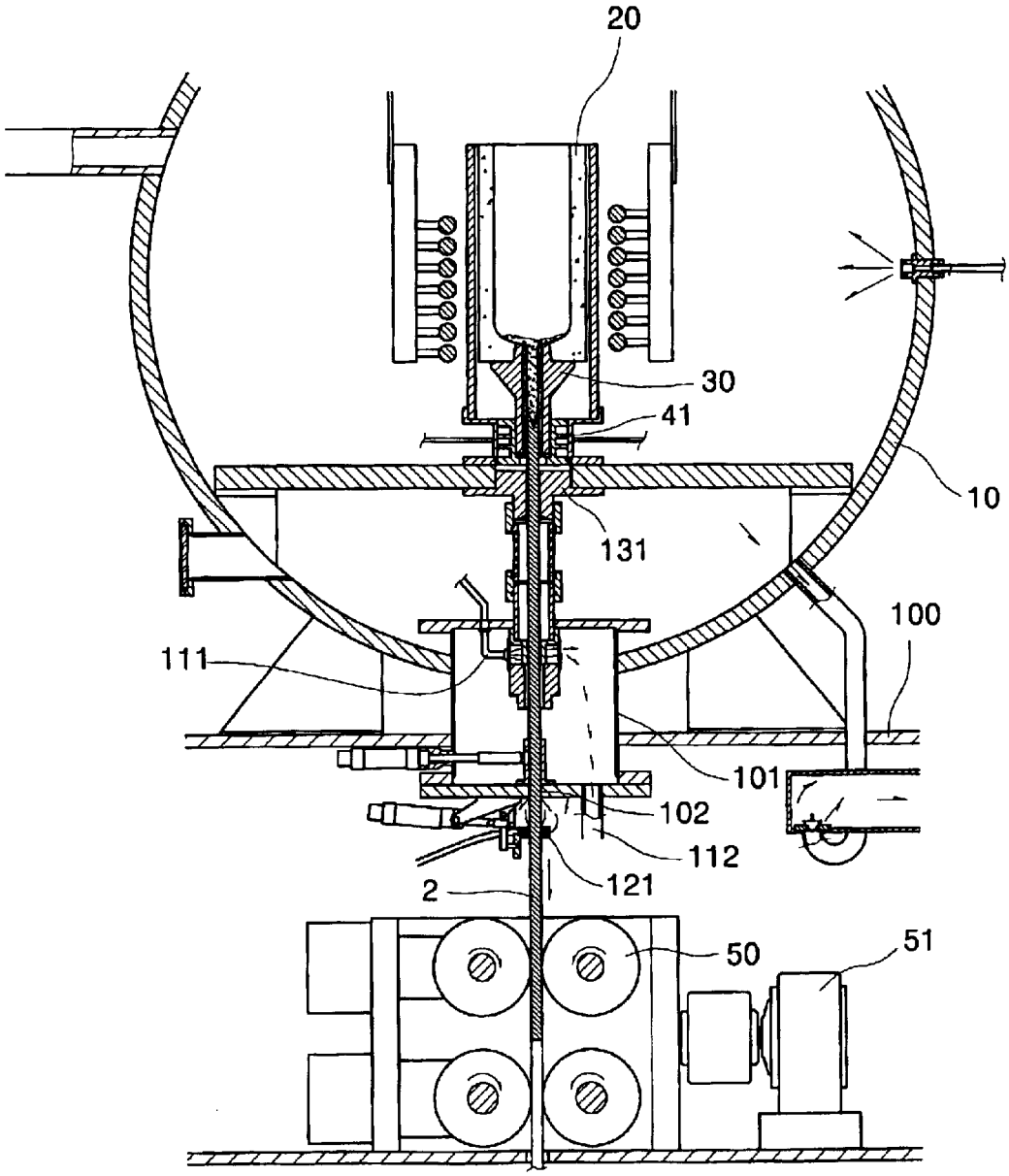
Figure 10F:
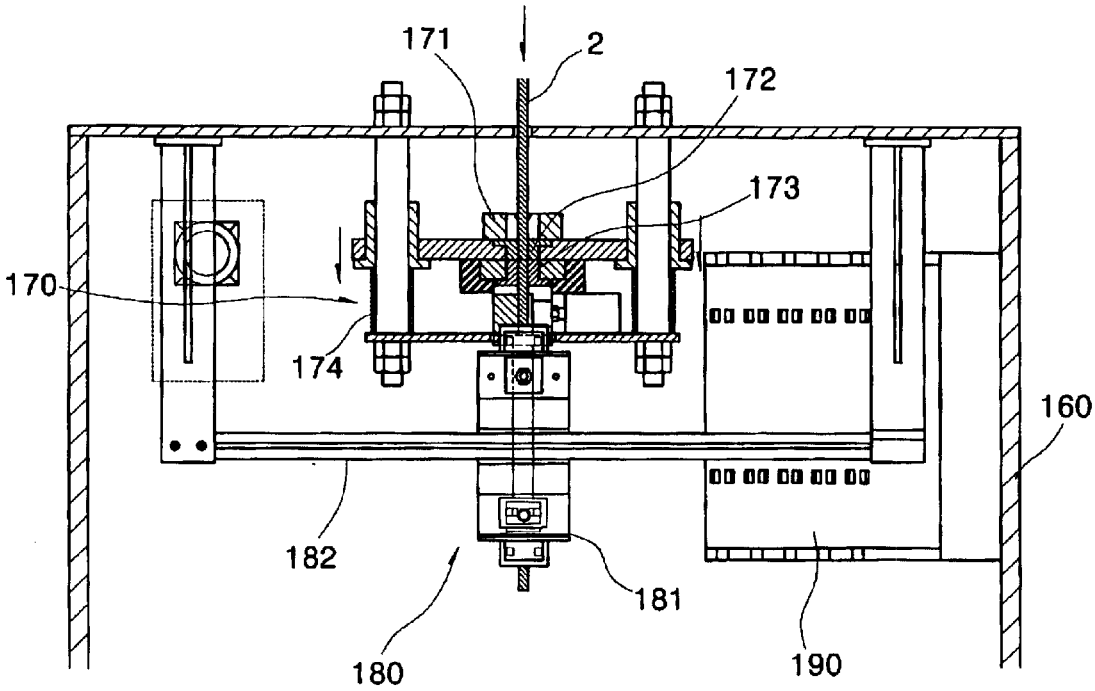
Figure 10G:
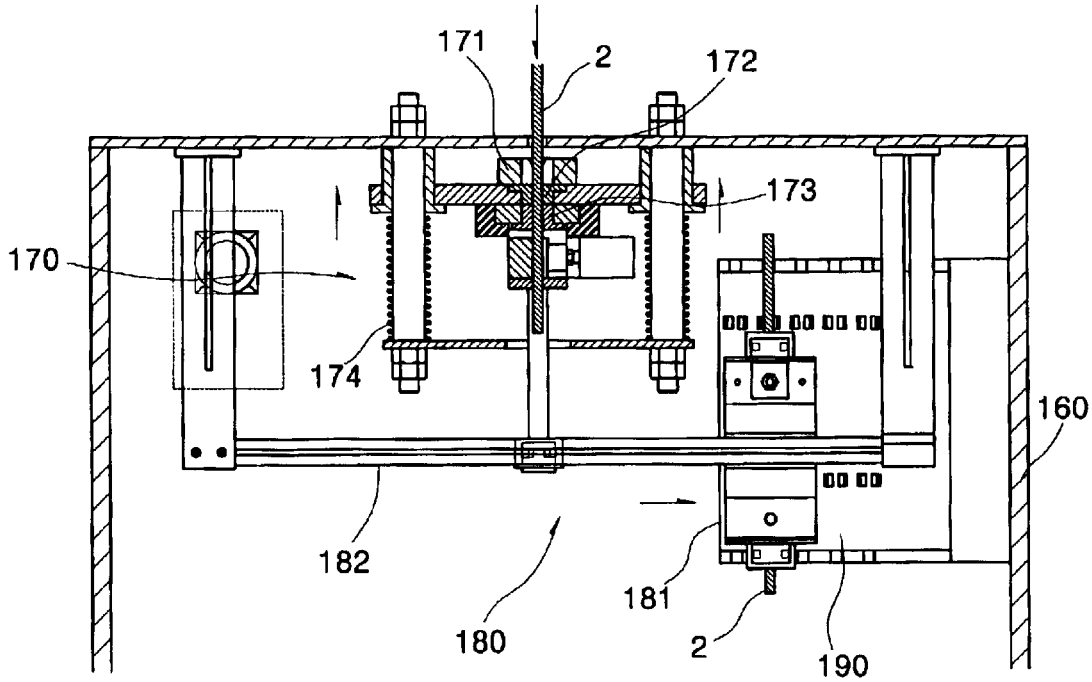

More particularly, FIG. 10*a* is a longitudinal-sectional view showing a step for forming a degree of vacuum, FIG. 10*b* is a longitudinal-sectional view showing a step for forming an inert gas atmosphere, FIG. 10*c* is a longitudinal-sectional view showing a step for assembling the start rod, FIG. 10*d* is a longitudinal-sectional view showing a step for downwardly moving the start rod, thereby casting a uranium rod, FIG. 10*e* is a longitudinal-sectional view showing a step for exhausting the cast uranium rod, FIG. 10*f* is a longitudinal-sectional view showing a step for cutting the cast uranium rod; and FIG. 10*g* is a longitudinal-sectional view showing a step for transferring the uranium rod and storing the transferred uranium rod.

As shown in FIG. 10*a*, the metallic substance 3 reduced from nuclear spent fuel is introduced into the crucible 20. Then, the lid 92 is opened and the upper start rod 61 is inserted into the crucible 20 via the lid 92. When the lower surface of the crucible 20 is closed, the upper start rod 61 is fixed to the start rod-supporter 103 and the supporting rod 104. Next, when the passage 102 is again closed with the lid 92, the air within the air-sealed chamber 10 is sucked via the air exhaust pipe 71 near the air-sealed chamber 10, thereby forming a proper degree of vacuum.

As described above, the air-sealed chamber 10 is hermetically sealed and the designated degree of vacuum is formed within the air-sealed chamber 10. Than, the crucible 20 is heated by the high frequency induction coil 21 and the metallic substance reduced from nuclear spent fuel in the crucible 20 is melted. Impurities generated in melting the reduced metallic substance and gases mixed with the molten metal are removed in the step for forming the degree of vacuum, thereby forming degassed molten uranium.

The lower start rod 62 is disposed in the driving roller 50 within the shielding chamber 100.

Under the vacuum condition, the metallic substance 3 reduced from nuclear spent fuel is melted, thereby forming the molten metal. Then, as shown in FIG. 10*b*, the formation of the vacuum stops, thereby reversing the vacuum condition. Next, the inert gas is injected into the air-sealed chamber 10 via the inert gas injection pipe 81.

After the air-sealed chamber 10 is completely filled with the inert gas, as shown in FIG. 10*c*, when the inert gas is continuously injected into the air-sealed chamber 10 via the inert gas injection pipe 81, the lid 92 is operated by the hydraulic actuator 91 and the passage 102 of the hermetic connection pipe 101 is opened. Then, the lower start rod 62 disposed with the driving roller 50 moves upward and is engaged with the upper start rod 61.

As shown in FIG. 10*d*, the supporting rod 104 moves and is released from the upper start rod 61 engaged with the lower start rod 62. Then, when the upper and lower start rods 61 and 62 move downward by the driving roller 50, the molten uranium is in contact with the upper surface of the upper start rod 61, pulled down via the mold 30, and then cast into the uranium rod 2.

Herein, as the uranium molded via the mold 30 under the crucible 20 is cooled by the cooling jacket 41 and simultaneously cast into the uranium rod 2 in a solid state, the uranium rod 2 moves downward.

At this time, the worker sees with the naked eye the cast uranium rod 2 within the air-sealed chamber 10 through the quartz pipe 141 and the transparent window 142, and inspects whether the uranium rod 2 is properly cast and pulled down.

The driving roller 50 is repeatedly driven and stopped, thereby pulling down the uranium rod 2. Therefore, the driving roller 50 prevents the break-out of the uranium rod in the pulling down step.

In order to form the air-sealed chamber 10 in the inert gas atmosphere, when the inert gas injected into the air-sealed chamber 10 via the inert gas injection pipe 81 is more than a designated pressure similar to atmospheric pressure, the inert gas of the air-sealed chamber 10 is introduced into the switching valve 83 via the inert gas exhaust pipe 82 and elevates the conical bob 833 of the weight switching part 832, thereby being exhausted to the outside. Thus, the inert gas in the air-sealed chamber 10 is maintained at a constant pressure.

As shown in FIG. 10*e*, the cast uranium rod is continuously pulled down by the driving roller 50 driven by the motor 51, and is cooled to less than 200° C. by the inert gas injection pipe 111 disposed within the hermetic connection pipe 101. Therefore, the non-oxidized uranium rod in the atmosphere is exhausted into the shielding chamber 100.

The inert gas injected from the inert gas injection pipe 11 so as to cool the uranium rod 2 is exhausted to the outside via the gas exhaust pipe 112. The noxious gas from the pulled down uranium rod 2 passes through the passage 102 of the hermetic connection pipe 101 and then is locally sucked by the suction device 121.

As shown in FIG. 10*f*, the pulled down uranium rod 2 is fixed to the fixing part 171 and cut by the lower cutting blade 173 of the cutting section 170 pulled down along with the uranium rod 2. Herein, the upper cutting blade 172 is stationary.

As shown in FIG. 10*g*, the cut uranium rod 2 is cutted by the fracture part 181, transferred into the storage shed 190 by the horizontal transferring part 182, and then stored in the storage shed 190.

Herein, the cutting section 170 releases the fixing part 171 from the uranium rod 2, and returns the fixing part to its former position by the spring 174, thereby repeatedly cutting the uranium rod 2.

That is, the uranium rod 2 is cut into constant lengths by the cutting section 170, transferred by the transferring section 180, and then stored in the storage shed 190 within the lower shielding chamber 160.

Therefore, the apparatus of the present invention casts and pulls down a degassed uranium rod 2 with a smooth and perfect surface, minimizes the break-out of the uranium rod, prevents the oxidation of the exhausted uranium rod, shields the radioactivity generated from uranium rod, easily sucks the noxious gas, and cuts and transfers the cast uranium rod, thereby assuring the safety of work and continuously casting the uranium rod.

As apparent from the above description, the present invention provides a method for continuously casting a uranium rod, in which impurities generated in melting the metallic substance reduced from nuclear spent fuel are easily removed, the molten metal is easily degassed, the oxidation of uranium is prevented, and no residue of the molten metal remains in a crucible, thereby safely casting a degassed uranium rod with removing the noxious gas, reducing the consumption rate of the inert gas, and completely preventing the oxidation of uranium.

Further, the present invention provides a method for continuously casting a uranium rod, in which the inert gas filling the air-sealed chamber has a constant pressure similar to the atmospheric pressure, thereby preventing the destruction of the air-sealed chamber due to the high pressure in the air-sealed chamber when the vacuum of the air-sealed chamber is reversed and the air-sealed chamber is filled with the inert gas.

Further, the present invention provides a method for continuously casting a uranium rod, in which the cast uranium rod is continuously pulled down without break-out, thereby preventing the stoppage of work due to the break-out of the uranium rod and the deterioration of productivity.

Further, the present invention provides a method for continuously casting a uranium rod, in which the cast uranium rod molded via a mold is cooled to a constant temperature, thereby preventing the break-out of the pulled down uranium rod due to the temperature difference.

Further, the present invention provides a method for continuously casting a uranium rod, in which the first cooled uranium rod is secondarily and completely cooled to less than the oxidation temperature of uranium by the inert gas prior to being exhausted into the shielding chamber, thereby preventing the oxidation of uranium after the exhaustion.

Further, the present invention provides a method for continuously casting a uranium rod, in which a noxious gas exhausted along with the uranium rod is completely sucked, thereby improving the safety of work and allowing the workers to be close to the apparatus.

Further, the present invention provides a method for continuously casting a uranium rod, in which the exhausted uranium rod is cut without interfering with the continuous casting process, thereby improving operation efficiency and repeatedly cutting the uranium rod using an elastic force.

Further, the present invention provides a method for continuously casting a uranium rod, in which the uranium rod is collectively cut, transferred and stored, thereby fully automating and making the continuous casting process more stable and precise.

And, the present invention provides an apparatus for continuously casting a uranium rod, in which impurities generated in melting a metallic substance reduced from a nuclear spent fuel being a highly radioactive substance are easily removed, the molten metal is easily degassed, the oxidation of uranium is prevented, and no residue of the molten metal remains in the crucible, thereby safely casting a degassed uranium rod while removing the noxious gas, reducing the consumption rate of the inert gas, completely preventing the oxidation of uranium, and being remotely controlled.

Further, the present invention provides an apparatus for continuously casting a uranium rod, in which a region including a driving roller under the air-sealed chamber is shielded from the radioactivity generated from the cast uranium rod, thereby improving the safety of work and allowing the workers to be close to the apparatus.

Further, the present invention provides an apparatus for continuously casting a uranium rod, in which the uranium rod within the mold is not breakout due to the sudden temperature difference but is continuously pulled down, thereby preventing the break-out of the uranium rod, easily casting a uranium rod with a smooth and perfect surface, and preventing the mold from being contaminated with radioactivity.

Further, the present invention provides an apparatus for continuously casting a uranium rod, in which a thermal loss in the crucible and the mold is prevented by an adiabatic material, thereby allowing the crucible and the mold to have a constant temperature gradient, preventing the break-out of the uranium rod, and more safely and continuously casting the uranium rod.

Further, the present invention provides an apparatus for continuously casting a uranium rod, in which the uranium rod, molded via the mold and pulled down from the mold, is firstly cooled, thereby safely hardening the uranium rod pulled down in the molten state.

Further, the present invention provides an apparatus for continuously casting a uranium rod, in which a start rod inserted into the crucible is stably supported and fixed, thereby preventing the leakage of the molten metal by the downward movement of the start rod due to the weight of the molten metal.

Further, the present invention provides an apparatus for continuously casting a uranium rod, in which the nuclear spent fuel is introduced from the upper part of the air-sealed chamber into the crucible, thereby introducing the metallic substance reduced from nuclear spent fuel into the crucible by remote control and minimizing the exposure of the workers to the radioactivity.

Further, the present invention provides an apparatus for continuously casting a uranium rod, in which the start rod is not easily melted by the molten uranium, and is easily assembled and disassembled, thereby preventing the melting of the start rod under the crucible together with melting the metallic substance reduced from nuclear spent fuel and easily forming vacuum in the air-sealed chamber.

Further, the present invention provides an apparatus for continuously casting a uranium rod, in which the uranium rod is easily cut without interfering with the continuous casting process, thereby improving operation efficiency of the continuous casting process.

Further, the present invention to provide an apparatus for continuously casting a uranium rod, in which the inert gas filling the air-sealed chamber is automatically exhausted when the inert gas is more than a designated pressure, thereby preventing the destruction of the air-sealed chamber due to the high pressure formed when the vacuum condition of the air-sealed chamber is released and then filled with the inert gas, and the leakage of the molten metal by the high pressure of the upper part of the molten metal.

Further, the present invention provides an apparatus for continuously casting a uranium rod, in which the air-sealed chamber is easily opened and closed, thereby automatically opening and closing the air-sealed chamber with a simple structure by remote control and easily forming a degree of vacuum in the air-sealed chamber by the stable opening and closing.

Further, the present invention provides an apparatus for continuously casting a uranium rod, in which the first cooled uranium rod is secondarily and completely cooled by the inert gas prior to being exhausted into the shielding chamber, thereby completely preventing the oxidation of uranium after the exhaustion.

Further, the present invention provides an apparatus for continuously casting a uranium rod, in which the noxious gas exhausted along with the uranium rod is locally and completely sucked, thereby improving the safety of work and allowing the workers to be close to the apparatus.

Further, the present invention provides an apparatus for continuously casting a uranium rod, in which the crucible, the mold, and the cooling section are stably supported within the air-sealed chamber, thereby preventing the warpage of the uranium rod cast within the air-sealed chamber of the high temperature and pressure, and stably pulling down the uranium rod.

Further, the present invention provides an apparatus for continuously casting a uranium rod, in which the uranium rod is cooled to a constant temperature by the cooling section, thereby preventing the break-out of the pulled down uranium rod due to the difference of the cooling temperature.

Further, the present invention provides an apparatus for continuously casting a uranium rod, in which the cut uranium rod is cutted and then transferred, thereby automatically and repeatedly performing the continuous casting process by a unmanned control and improving the safety of work and operation efficiency.

Further, the present invention provides an apparatus for continuously casting a uranium rod, in which the uranium rod pulled down via the mold and the cooling section within the air-sealed chamber is visually inspected by a worker with the naked eye, thereby being stopped in case break-outs or defects of the surface of the uranium rod are found so as to solve the problems, and preventing the defective uranium rod from being exhausted.

Moreover, the present invention provides an apparatus for continuously casting a uranium rod, in which the cut and transferred uranium rod is properly stored in the lower shielding chamber, thereby automatically cutting, transferring and storing the uranium and improving the safety of the continuous casting process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A continuous casting apparatus, comprising:

an air-sealed chamber including a crucible surrounded with a high frequency induction coil, a mold and a cooling section sequentially disposed under the crucible, a start rod for casting and pulling down a uranium rod via the mold with a driving roller disposed below the air-scaled chamber;

a vacuum generating section for forming a vacuum in the air-sealed chamber, the vacuum generating section including an air exhaust pipe disposed on a first side of the air-sealed chamber so as to communicate with the air-sealed chamber and a suction pump formed on the air exhaust pipe;

an inert gas generating section for establishing an inert gas atmosphere in the air-sealed chamber, the inert gas generating section including an inert gas injection pipe disposed on a second side of the air-sealed chamber, and an inert gas exhaust pipe disposed on a lower surface of the air-sealed chamber and including a switching valve; and a switching section for opening and closing a route for moving the uranium rod pulled down by the driving roller, wherein the switching valve includes:

a high pressure-down pipe in a rectangular shape connected to the inert gas exhaust pipe;

a weight switching part located within the high pressure-down pipe and opened and closed by a conical bob with a designated weight; and the conical bob formed on a tip of the inert gas exhaust pipe.

2. The continuous casting apparatus as set forth in claim 1, further comprising a shielding chamber surrounding the driving roller, the shielding chamber including a hermetic connection pipe including a passage for the uranium rod under the air-sealed chamber, wherein the switching section is formed on a lower surface of the hermetic connection pipe.

3. The continuous casting apparatus as set forth in claim 1, wherein the mold comprises;

a mold body including an inserting part inserted into a hole of a lower surface of the crucible, a heat including part formed integrally with a lower part of the inserting part, and an exhausting part vertically and integrally formed with a lower part of the heat insulating part;

a molding hollow vertically formed on a center of the mold body; and a silicon nitride lube attached to an inner wall of the molding hollow.

4. The continuous casting apparatus as set forth in claim 1, wherein the crucible and the mold are surrounded with an adiabatic material including graphite.

5. The continuous casting apparatus as set forth in claim 1, wherein the cooling section comprises:

a cooling jacket surrounding a lower part of the mold; and cooling water flow tubes formed within the cooling jacket so as to provide cooling water.

6. The continuous casting apparatus as set forth in claim 2, further comprising a start rod-supporter formed on a surface of the passage within the hermetic connection pipe, and a supporting rod disposed on a designated position of a side surface of the start rod-supporter, the supporting rod being hydraulically operated.

7. The continuous casting apparatus as set forth in claim 1, further comprising a switching door farmed on an upper surface of the air-sealed chamber, the switching door being opened and closed by a hydraulic cylinder.

8. The continuous casting apparatus as set forth in claim 1, wherein the start rod comprises:

an upper start rod including a fixing halo on a lower surface thereof and a removable part formed on an upper surface of the fixing hole; and a lower start rod including on an upper surface thereof a faxing protrusion inserted into the fixing hole of the upper start rod and fixed to the removable part of the upper start rod.

9. The continuous casting apparatus as set forth in claim 1, further comprising:

a lower shielding chamber formed on a lower surface of the driving roller; and a cutting section including:

a fixing part for fixing the uranium rod pulled down into the lower shielding chamber;

upper and lower cutting blades for cutting the uranium rod under the fixing part; and a spring for elastically returning the fixing part to a former position thereof so as to repeatedly cut the uranium rod.

10. The continuous casting apparatus as set forth in claim 2, wherein the switching section comprises:

a hydraulic actuator installed on the lower surface of the hermetic connection pipe and hydraulically operated; and a lid operated by the hydraulic actuator.

11. The continuous casting apparatus as set forth in claim 2, further comprising a gas cooling section including:

an inert gas injection pipe disposed within the hermetic connection pipe; and a gas exhaust pipe formed on the lower surface of the hermetic connection pipe.

12. The continuous casting apparatus as set forth in claim 2, further comprising a local suction section including:

a suction device disposed near the switching section within the shielding chamber and having a plurality of suction holes;

a flow tube with its one terminal connected to the back surface of the suction device; and a suction pump connected to the second terminal of the flow tube and formed outside the shielding chamber.

13. The continuous casting apparatus as set forth in claim 5, further comprising a supporting section including:

a supporter formed on the lower surface of the cooling jacket and including a vertical through hole at its center; and a bearing plate centrally supporting the supporter and disposed within the air-sealed chamber.

14. The continuous casting apparatus as set forth in claim 5, further comprising a cooling water volume controlling section controlling the cooling section to cool the uranium rod to a constant temperature and including:

thermocouples disposed within the mold; and a controller for controlling a cooling water volume of the cooling jacket according to the temperature sensed by the thermocouples.

15. The continuous casting apparatus as set forth in claim 9, further comprising a transferring section including:

a fracture part for fracturing the cut uranium rod formed under the cutting section; and a horizontal transferring part for horizontally transferring the cut uranium rod.

16. The continuous casting apparatus as set forth in claim 13, further comprising a visual inspection section including:

a quartz pipe vertically formed on the vertical through hole under the supporter; and a transparent window formed on the air-sealed chamber corresponding to the quartz pipe.

17. The continuous casting apparatus as set forth in claim 15, further comprising a storage shed for storing the transferred uranium rod near the transferring section.

* * * * *